US007565094B2

(12) United States Patent
Ishikawa

(10) Patent No.: US 7,565,094 B2
(45) Date of Patent: Jul. 21, 2009

(54) PROCESS CARTRIDGE, PHOTOSENSITIVE MEMBER CARTRIDGE, DEVELOPER CARTRIDGE AND DEVELOPER CARTRIDGE FOR USE IN IMAGE FORMING APPARATUS

(75) Inventor: Satoru Ishikawa, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 477 days.

(21) Appl. No.: 11/420,910

(22) Filed: May 30, 2006

(65) Prior Publication Data

US 2006/0275052 A1 Dec. 7, 2006

(30) Foreign Application Priority Data

May 31, 2005 (JP) ..... 2005-159430

(51) Int. Cl.
*G03G 21/16* (2006.01)

(52) U.S. Cl. ..... 399/111; 399/113; 399/119

(58) Field of Classification Search ..... 399/111, 399/113, 119
See application file for complete search history.

(56) References Cited

U.S. PATENT DOCUMENTS

| | | | | |
|---|---|---|---|---|
| 6,101,350 | A | 8/2000 | Suzuki et al. | |
| 2004/0086300 | A1 * | 5/2004 | Kawai et al. | 399/167 |
| 2004/0131382 | A1 * | 7/2004 | Kikuchi et al. | 399/109 |
| 2004/0190932 | A1 | 9/2004 | Ishii | |

FOREIGN PATENT DOCUMENTS

| | | | |
|---|---|---|---|
| JP | 2000250310 | A | 9/2000 |
| JP | 2004301944 | A | 10/2004 |

* cited by examiner

*Primary Examiner*—David M Gray
*Assistant Examiner*—Bryan P Ready
(74) *Attorney, Agent, or Firm*—Banner & Witcoff, Ltd.

(57) ABSTRACT

A photosensitive member cartridge, including a photosensitive member, is provided with a lock device and a protection wall for the lock device. A developer cartridge includes a developer containing chamber and an inlet. The inlet is disposed so that the protection wall for the lock device at least partially overlaps the inlet when the developer cartridge is received in the photosensitive member cartridge.

15 Claims, 23 Drawing Sheets

PROCESS CARTRIDGE, PHOTOSENSITIVE MEMBER CARTRIDGE, DEVELOPER CARTRIDGE AND DEVELOPER CARTRIDGE FOR USE IN IMAGE FORMING APPARATUS

CROSS REFERENCE TO RELATED APPLICATION

This application claims priority from Japanese Patent Application No. 2005-159430, filed on May 31, 2005, the entire subject matter of which is incorporated herein by reference.

FIELD

Aspects of the invention relate to an image forming apparatus employed in a copier, a facsimile, a laser printer and the like, and to a process cartridge, a photosensitive member cartridge and a developer cartridge for use in the image forming apparatus.

BACKGROUND

In known image forming apparatuses, characters or image data are recorded as follows: a developer is supplied to an electrostatic latent image formed on a photosensitive member (photosensitive drum) to develop it into a visible image; and the visible image is transferred onto a recording medium. Of the known image forming apparatuses, a cartridge-type process unit as disclosed in, for example, JP 20000-250310, is employed in order to facilitate operations such as for maintenance and replacement.

The process unit (or process cartridge) is a photosensitive member cartridge having a photosensitive member (photosensitive drum) and a developer cartridge having a developing roller in an assembled condition. The developer cartridge is formed with an inverted triangular-shaped action-receiving portion, protruding from an outer surface of each side of the developer cartridge. When the developer cartridge is completely set in the photosensitive member cartridge, the action-receiving portion is restrained from above by a lower contact portion of a lock lever that is formed on a sidewall of the photosensitive member cartridge, so that the developer cartridge is prevented from becoming detached from the photosensitive member cartridge. In addition, the developer cartridge includes a toner containing chamber and an inlet through which toner is supplied to the toner containing chamber. The inlet is disposed so that it is exposed, when the developer cartridge is attached to the photosensitive member cartridge, from a sidewall of the developer cartridge opposite from the sidewall of the photosensitive member cartridge where the lock lever is formed.

SUMMARY

Aspects of the invention provide a process cartridge, a photosensitive member cartridge, and a developer cartridge, for use in an image forming apparatus, that are configured to prevent toner leakage from an inlet due to a strong external impact.

BRIEF DESCRIPTION OF THE DRAWINGS

Illustrative aspects of the invention will be described in detail with reference to the following figures wherein.

DETAILED DESCRIPTION

Figure 1:
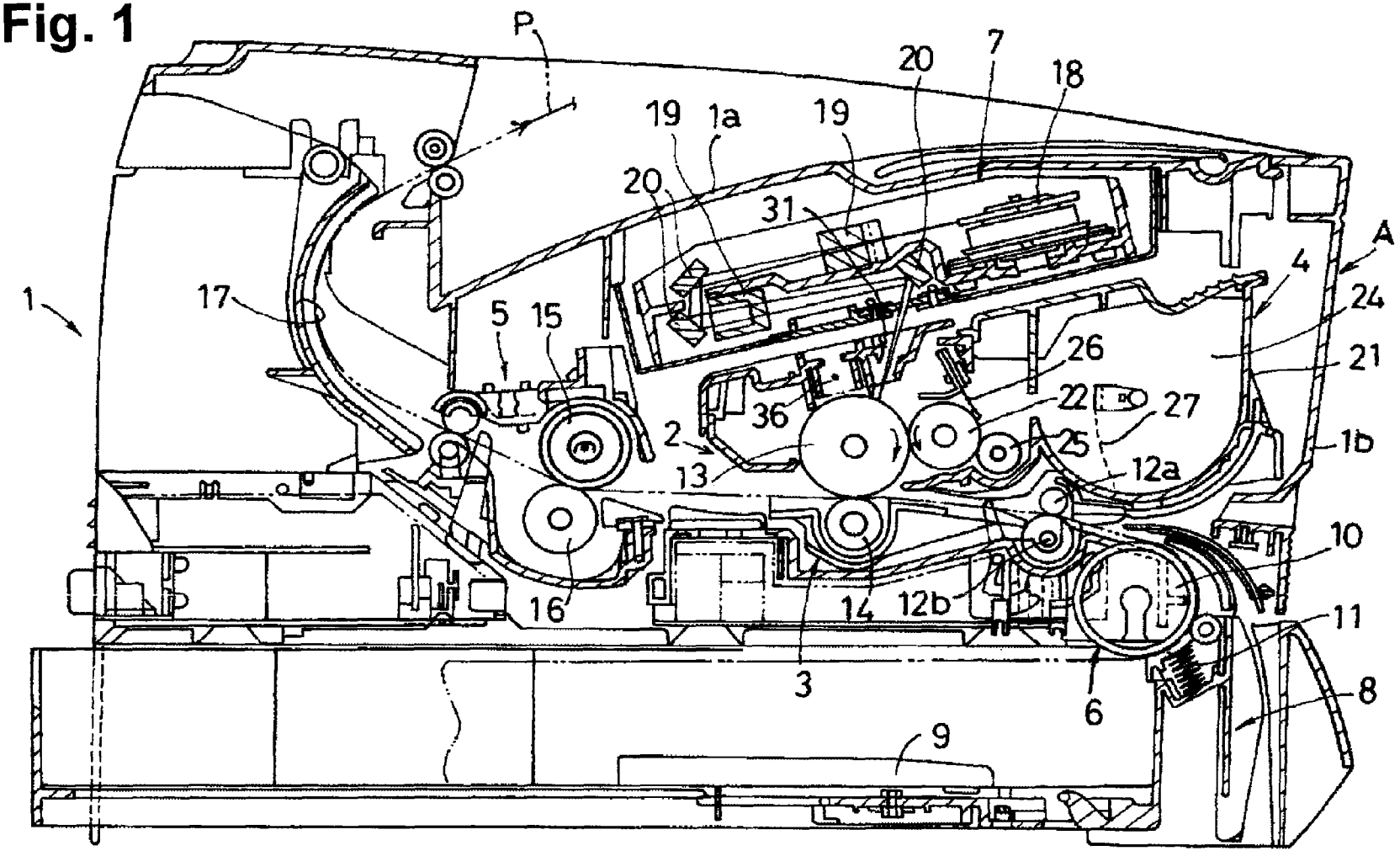
FIG. 1 is a schematic side sectional view of a printer according to at least one aspect of the invention.

Illustrative aspects of the invention in a laser beam-type printer will be described in detail hereinafter with reference to the accompanying drawings. FIG. 1 is a schematic side sectional view of a printer as the image forming apparatus according to illustrative aspects of the invention. As shown in FIG. 1, the process cartridge 2 having a photosensitive member cartridge 3 and a developer cartridge 4 is removably disposed in a substantially central portion of the body housing 1 of the printer. As shown in a left portion of FIG. 1, a fixer 5 is disposed adjacent to the process cartridge 2. A sheet feeder 6 is disposed below the process cartridge 2. A sheet cassette 8 is attachable to a lower portion of the body housing 1 by moving the sheet cassette 8 from a front face of the body housing 1 (as indicated by arrow A). A laser scanning unit 7 is mounted to a lower surface of a synthetic resin-made discharge sheet tray 1*a*, via a frame. The discharge sheet tray 1*a* also serves as a cover.

When print data is transmitted to the printer from an external apparatus (not shown), for example, a personal computer, upon a print instruction, a sheet P is separated from a stack of sheets P on a support plate 9 of the sheet cassette 8 by a separator pad 11, in a manner of one sheet at a time, as a sheet feed roller 10 of the sheet feeder 6 rotates. The separated sheet P is conveyed to a contact portion between a photosensitive drum 13, which is a photosensitive member in the process cartridge 2, and a transfer roller 14 pressed against a lower face of the photosensitive drum 13, via a pair of register rollers 12*a*, 12*b*. The laser scanning unit 7 includes a laser light-emitting portion, a polygon mirror 18, a lens 19, and reflecting mirrors 20. A laser beam is emitted from the laser scanning unit 7 through a light-emitting hole formed in a lower portion of the frame supporting the laser scanning unit 7. The laser beam travels to an upper peripheral surface portion of the photosensitive drum 13, via a light entrance portion 31 formed in a case 30 of the photosensitive member cartridge 3, that is, a case of the process cartridge 2. The peripheral surface of the photosensitive drum 13 is thereby exposed to the laser beam in response to the print data, so as to form an electrostatic latent image.

Developer (toner) supplied from a developing roller 22 of the developer cartridge 4 becomes deposited on the electrostatic latent image on the photosensitive drum 13, thereby making the image visible. After the visible image formed by developer (toner) is transferred from the photosensitive drum 13 to the sheet P, the sheet P is conveyed between a heat roller 15 and a presser roller 16 in the fixer 5, in which the sheet P is subjected to a heat-fixing process. The sheet P is then discharged onto the discharge sheet tray 1*a* via a sheet discharge path 17.

Although the developer cartridge 4 according to this aspect includes the developing roller 22 in a case 21, it may be configured in any manner as long as it includes at least a toner containing chamber 24 for storing developer (toner) and an inlet through which toner is supplied to the toner containing chamber 24. The process cartridge 2 in this aspect refers to the developer cartridge 4 being attached to the photosensitive member cartridge 3.

The structures of the photosensitive member cartridge 3 and the developer cartridge 4 will now be described in detail.

Figure 2:
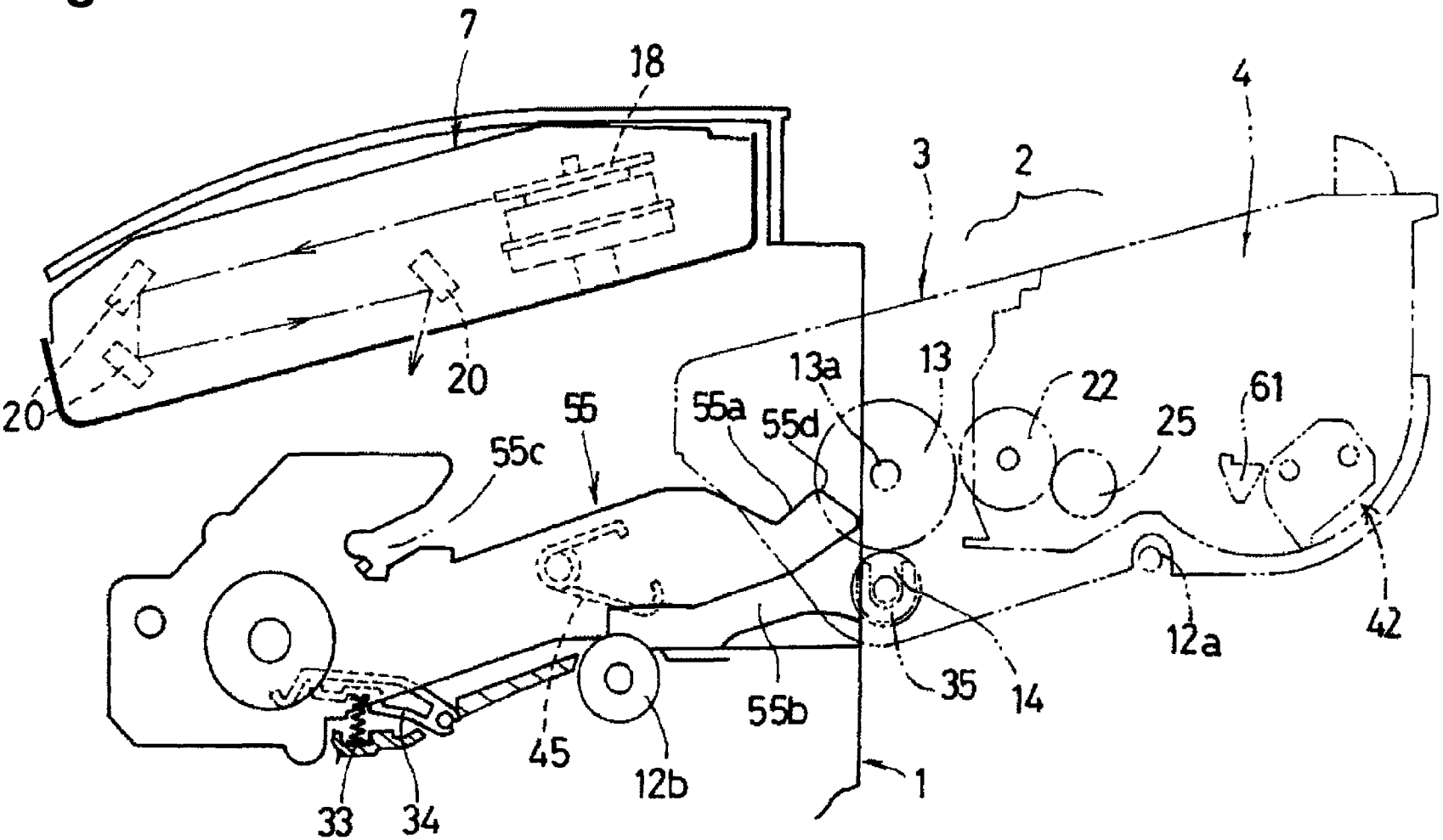
FIG. 2 is a side view illustrating a state where a process cartridge is being inserted into a body housing according to at least one aspect of the invention.
Figure 6:
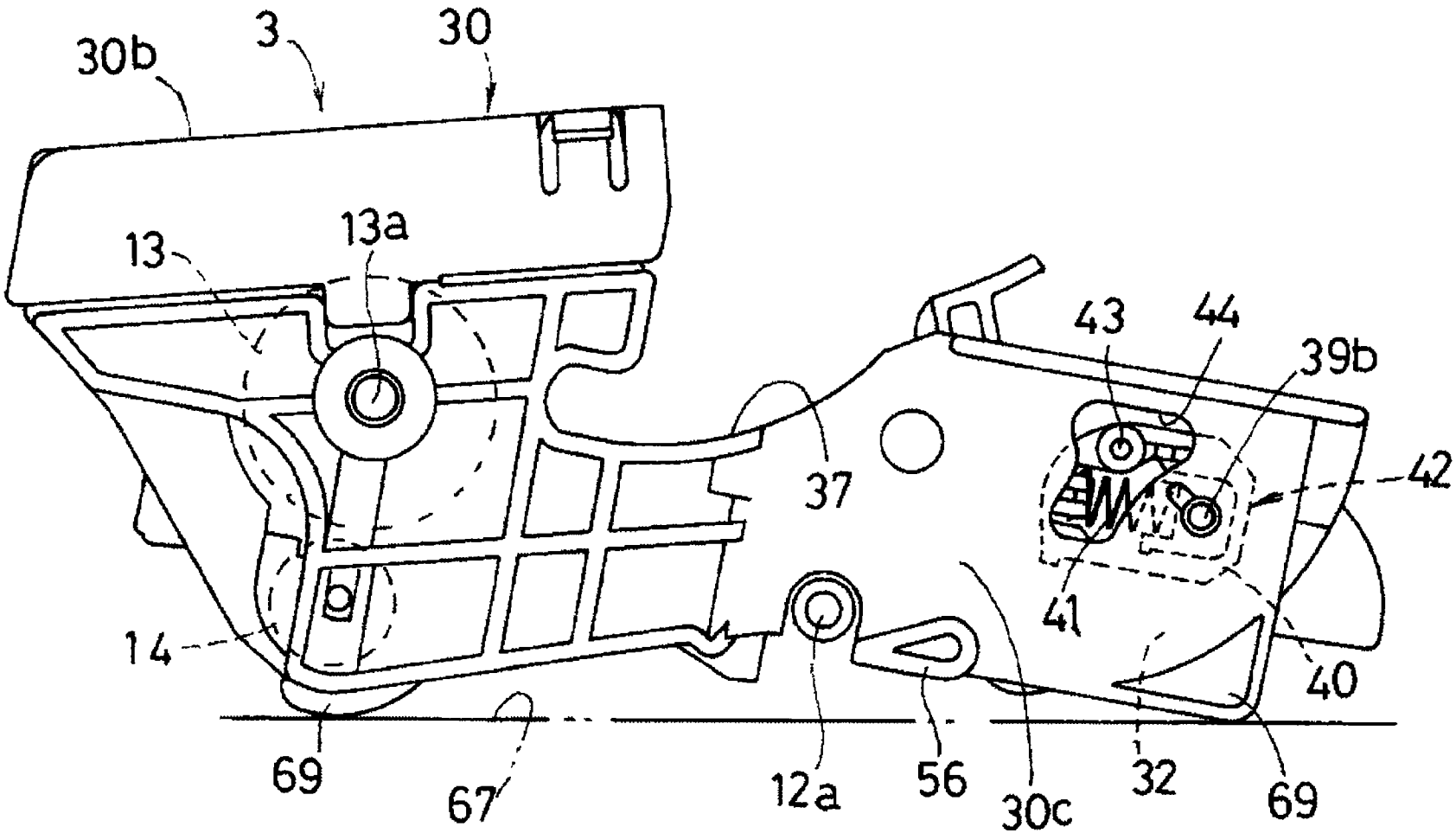
FIG. 6 is a left side view of the photosensitive member cartridge of FIG. 3.
Figure 7:
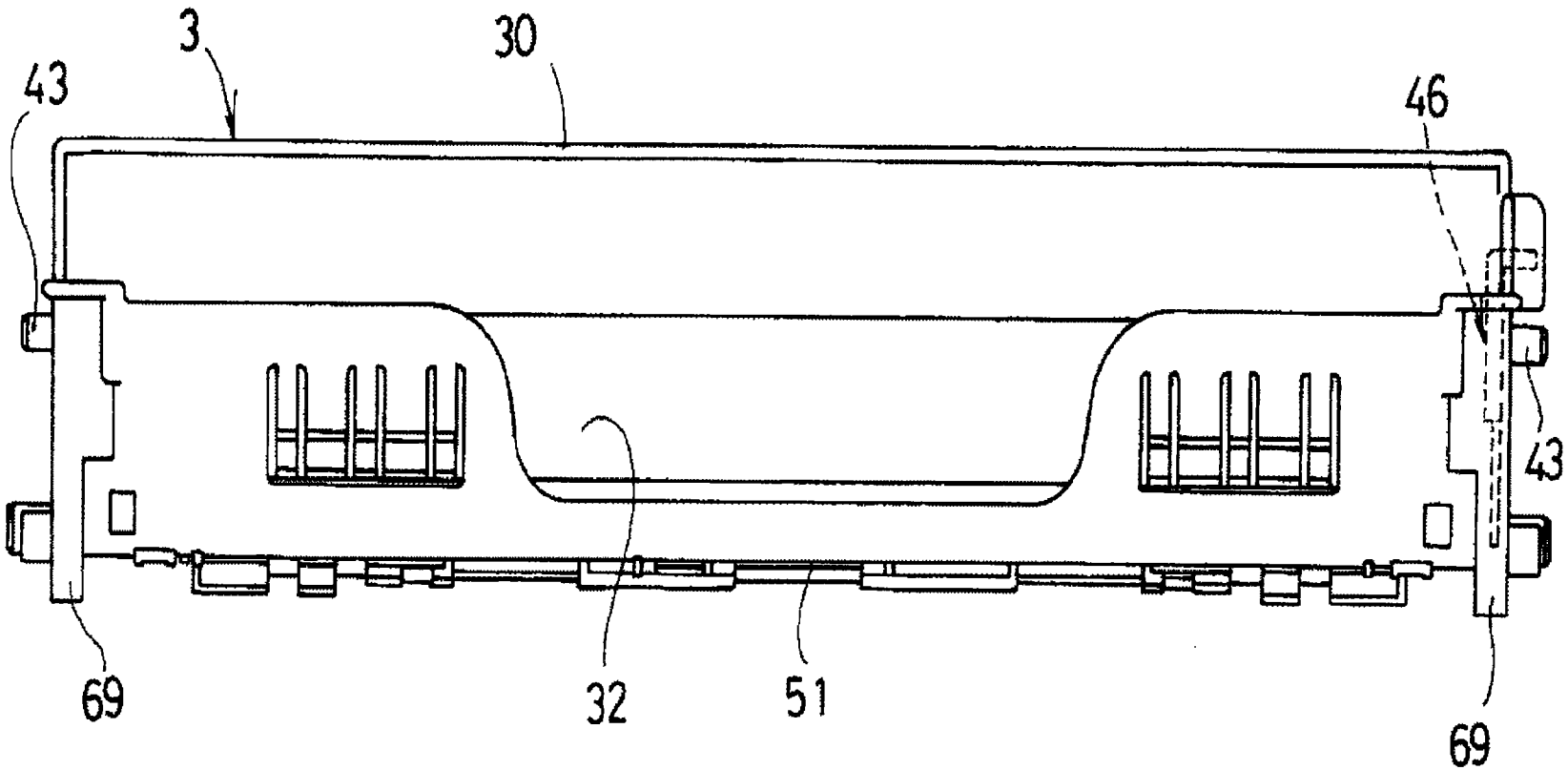
FIG. 7 is a front view of the photosensitive member cartridge of FIG. 3.
Figure 8:
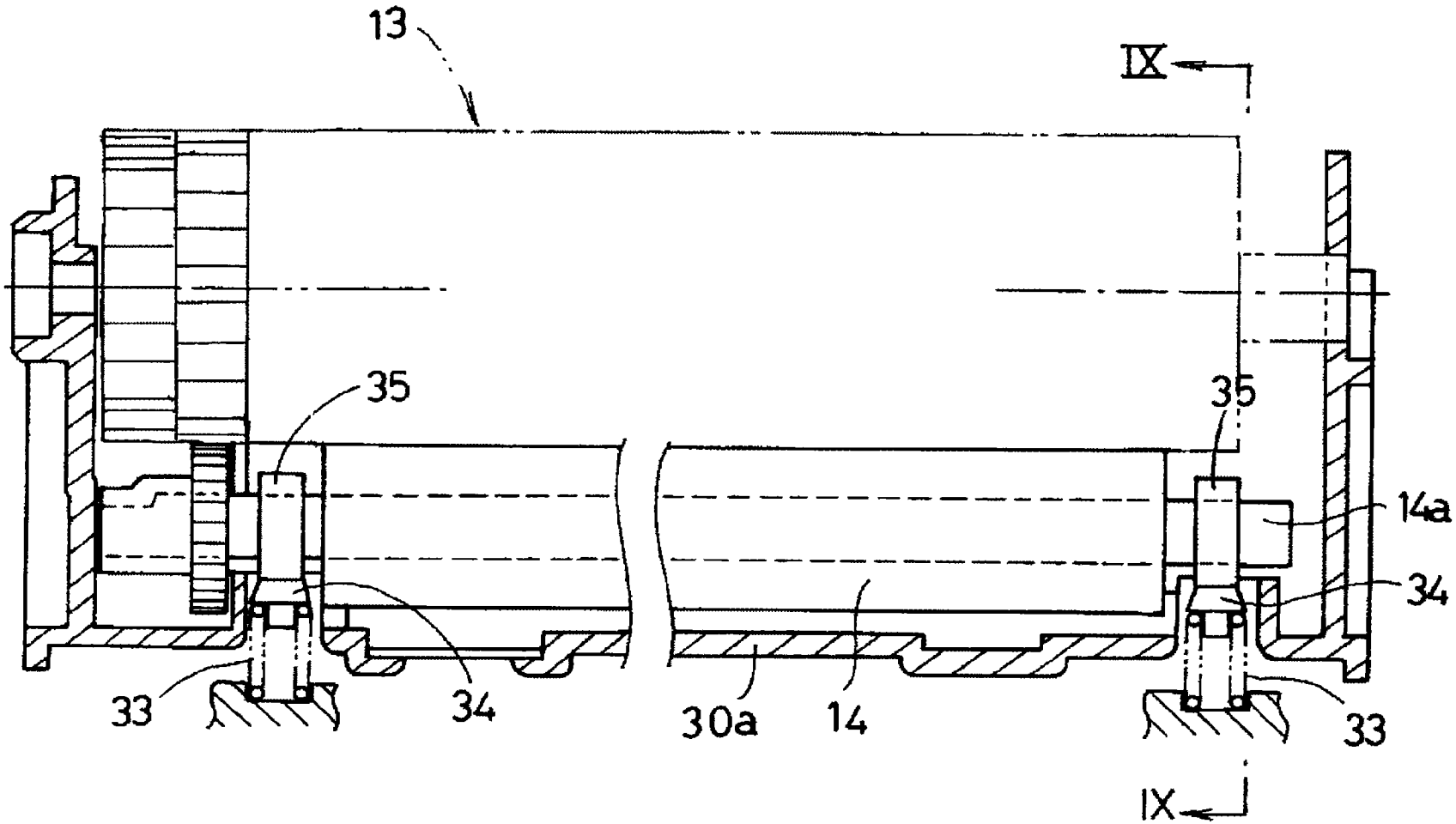
FIG. 8 is a partially cut-away sectional view illustrating a pressing portion of a transfer roller according to at least one aspect of the invention.
Figure 9:
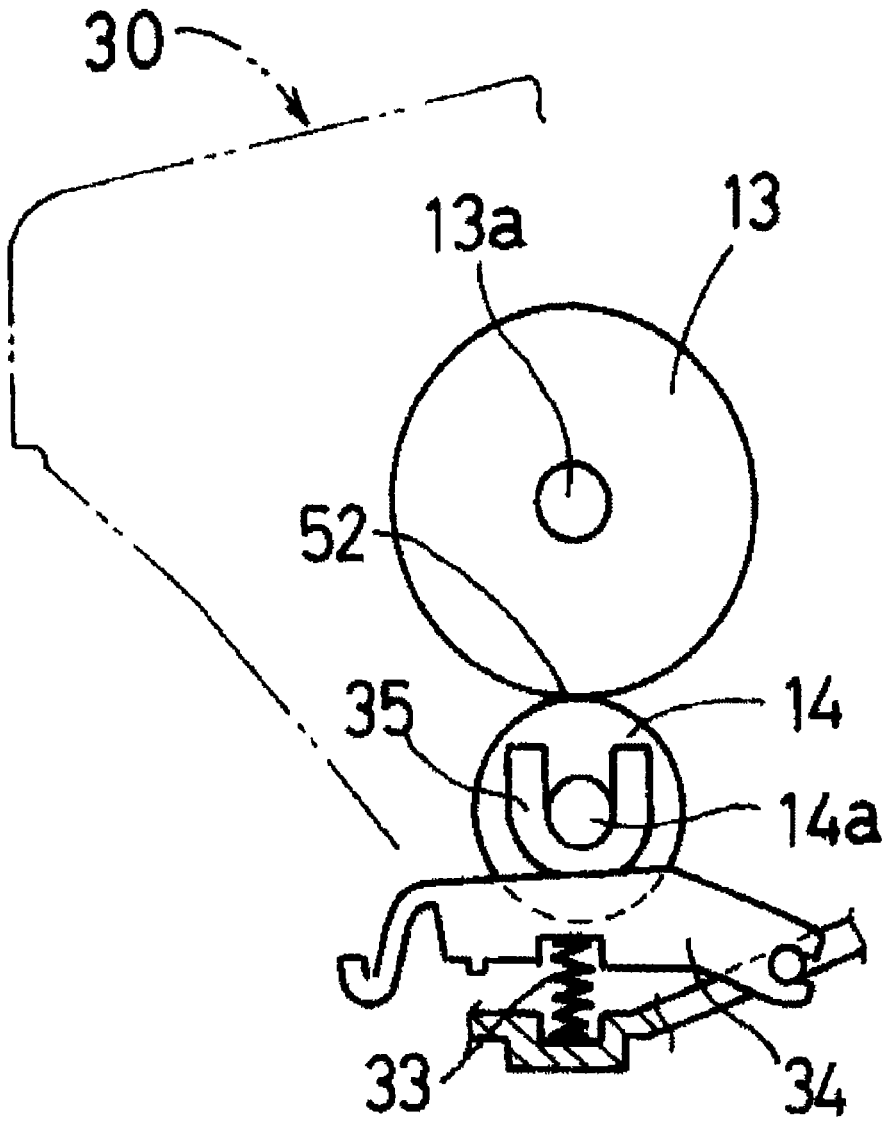
FIG. 9 is a sectional view taken along the line IX-IX in FIG. 8.

As shown in FIGS. 3 through 7, in the photosensitive member cartridge 3, the photosensitive drum 13 is rotatably supported within the synthetic resin-made case 30. A lower portion of the transfer roller 14 disposed below the photosensitive drum 13 is covered with a bottom wall 30*a* of the case 30 (see FIG. 4). The transfer roller 14 is vertically movably supported in such a manner that the transfer roller 14 can separate from a lower surface of the photosensitive drum 13 due to the weight of the transfer roller 14. When the process cartridge 2 is set into the body housing 1, as shown in FIGS. 2, 8 and 9, upwardly open "U"-shaped bearings 35 fitted to both end portions of a shaft 14*a* of the transfer roller 14 are raised by shaft bearing raiser 34 that are urged upward by springs 33 disposed at the right and left side inner faces of the body housing 1, so that the transfer roller 14 is moved upward to press a lower surface (transfer region) of the photosensitive drum 13.

An upper wall 30*b* of the case 30 of the photosensitive member cartridge 3 covers an upper portion of the photosensitive drum 13. The light entrance portion 31, allowing irradiation of an upper surface of the photosensitive drum 13 with laser light emitted from the laser scanning unit 7, is formed in the upper wall 30*b*, and is elongated in the directions of an axis the photosensitive drum 13. Disposed adjacent to the light entrance portion 31 is a charger 36, such as a scorotron or the like, that charges a photosensitive surface of the photosensitive drum 13 that is formed from an organic photosensitive material or the like. An electrostatic latent image is formed on the surface of the photosensitive drum 13 by scanning laser light over the surface uniformly charged by the charger 36. After the electrostatic latent image is made visible (developed) by deposition thereon of a thin layer of toner supplied via the developing roller 22 (described later) to form a toner image, the toner image is transferred to the sheet P in a press-transfer region defined by the photosensitive drum 13 and the transfer roller 14.

Figure 13:
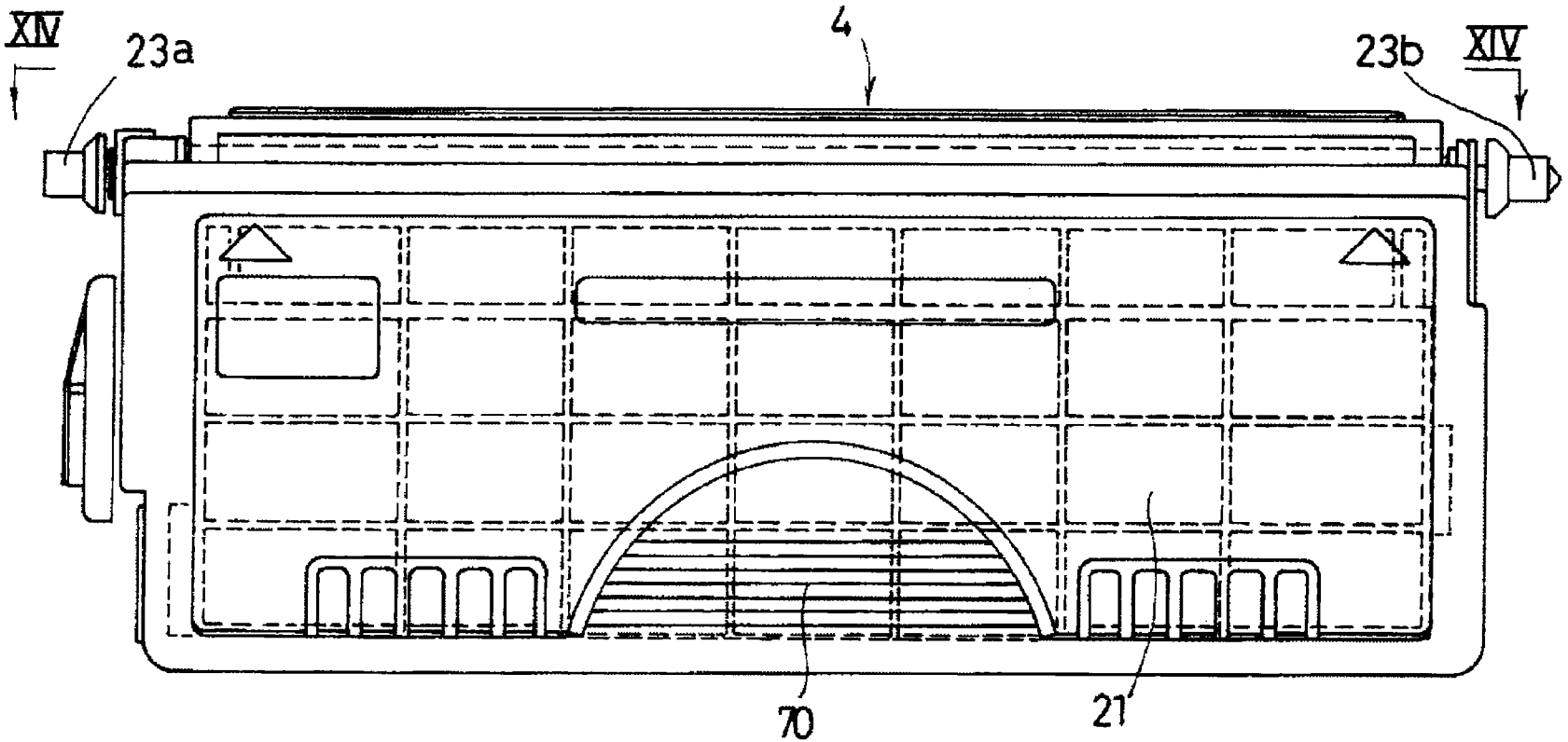
FIG. 13 is a plan view of the developer cartridge of FIG. 12A.
Figure 14:
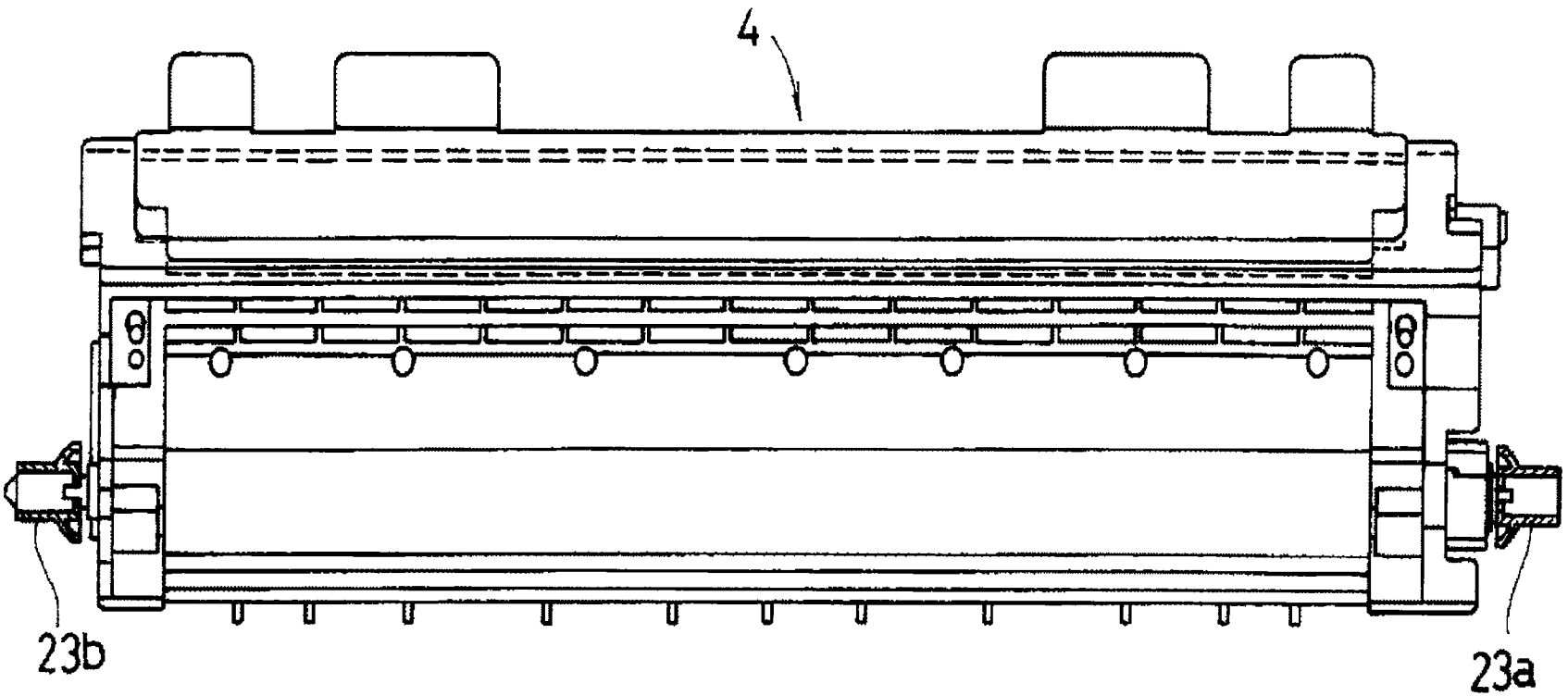
FIG. 14 is a view of the developer cartridge taken along the line XIV-XIV in FIG. 13.
Figure 15:
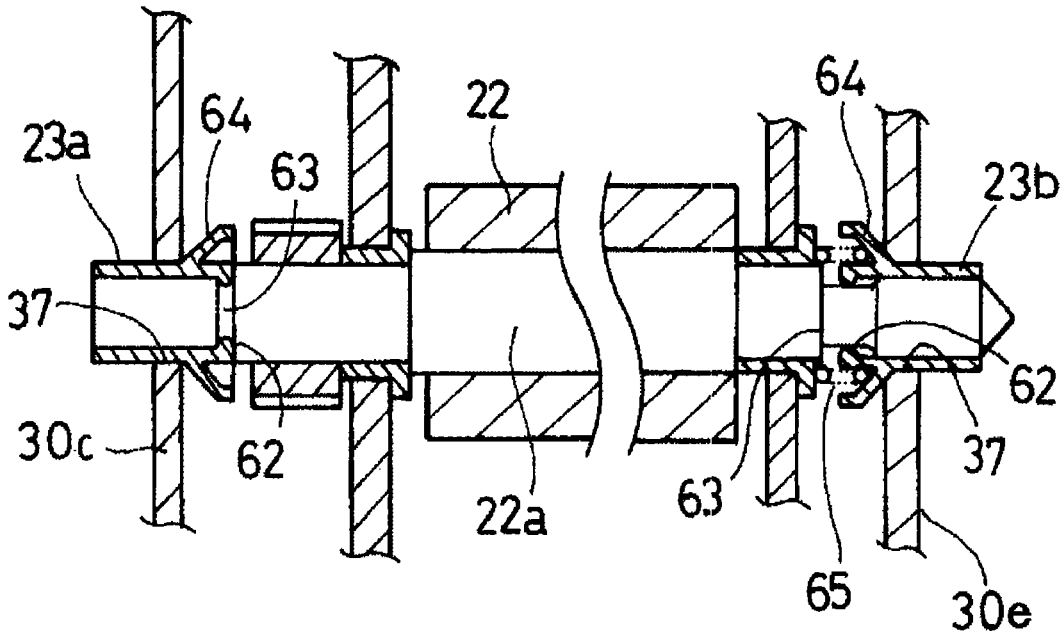
FIG. 15 is a sectional view of the developer cartridge of FIG. 12A illustrating the structure of shaft bearings disposed at the right and left sides of the developer cartridge according to at least one aspect of the invention.

An upper portion of the case 30 other than the upper wall 30*b* is open to define an accommodating portion 32 into which the developer cartridge 4 can be detachably set from above. An upper end face of each of right and left sidewalls 30*c*, 30*e* of the case 30 defines a downwardly arched guide groove 37 as a guide device to guide a corresponding one of bearings 23*a*, 23*b* (see FIGS. 13 through 15) fitted to both end portions of the developing roller shaft 22*a* of the developing roller 22 while supporting the bearing slidably. The guide grooves 37 extend toward a shaft 13*a* of the photosensitive drum 13. The guide grooves 37 are not limited to the downwardly arched shape. FIG. 23 shows side sectional views of the sidewall 30*e* of the photosensitive member cartridge 3 looking from inside. For the sake of convenience, the photosensitive member cartridge 3 is shown so that its bottom wall is on the left side in each drawing. When the photosensitive member cartridge 3 is placed on a horizontal surface such as a tabletop, a guide groove 370 may be inclined downward at a specified angle (e.g. 15 degrees) as the developer cartridge 4 is inserted, as shown in FIG. 23. This inclination improves the insertion of the developer cartridge.

Figure 4:
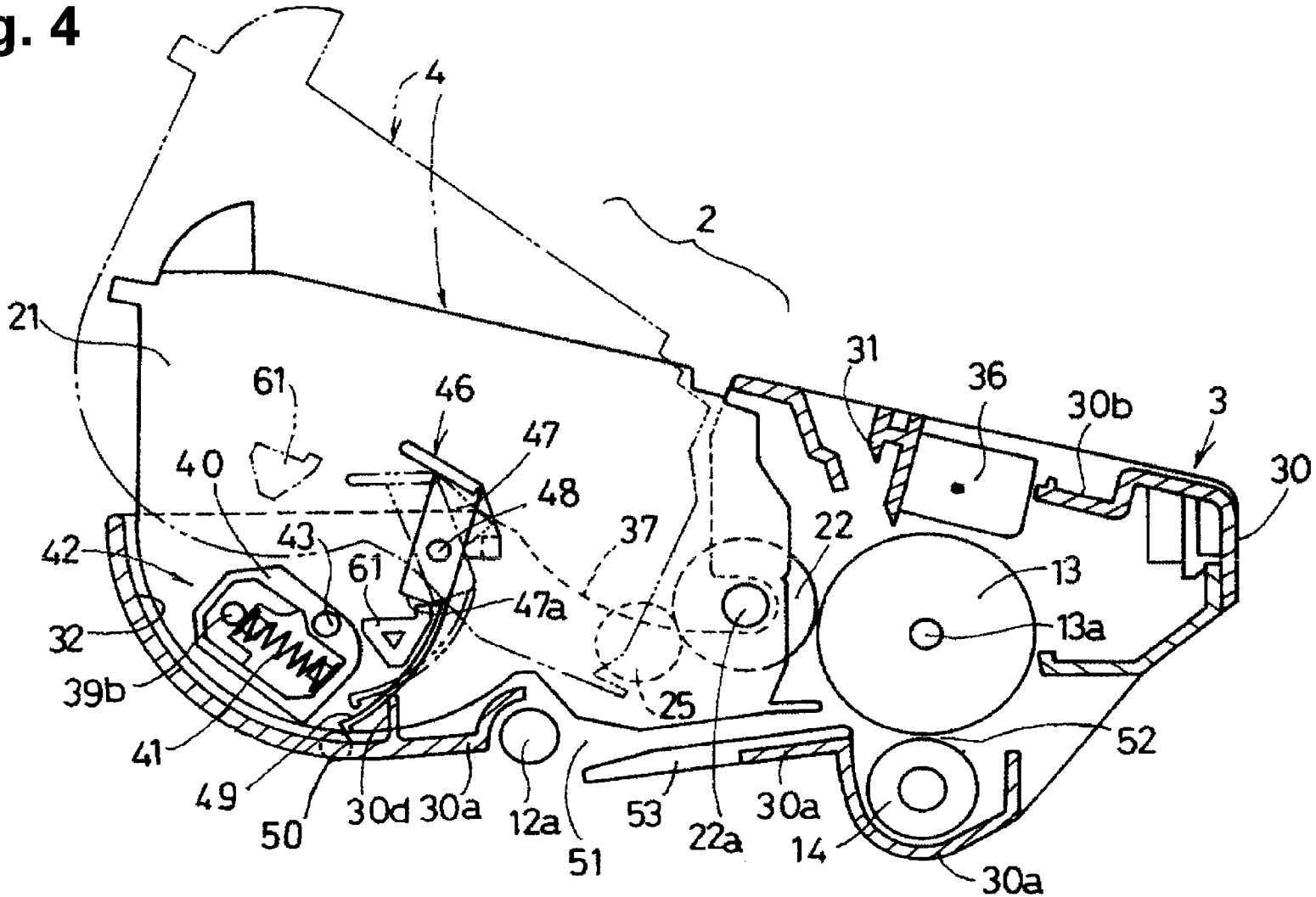
FIG. 4 is a side sectional view of the photosensitive member cartridge taken along the line IV-IV in FIG. 3.

Therefore, when the developer cartridge 4 is set with respect to the photosensitive member cartridge 3, the developing roller 22 can be positioned adjacent to the photosensitive drum 13 so that they face each other (see FIG. 4).

Figure 10:
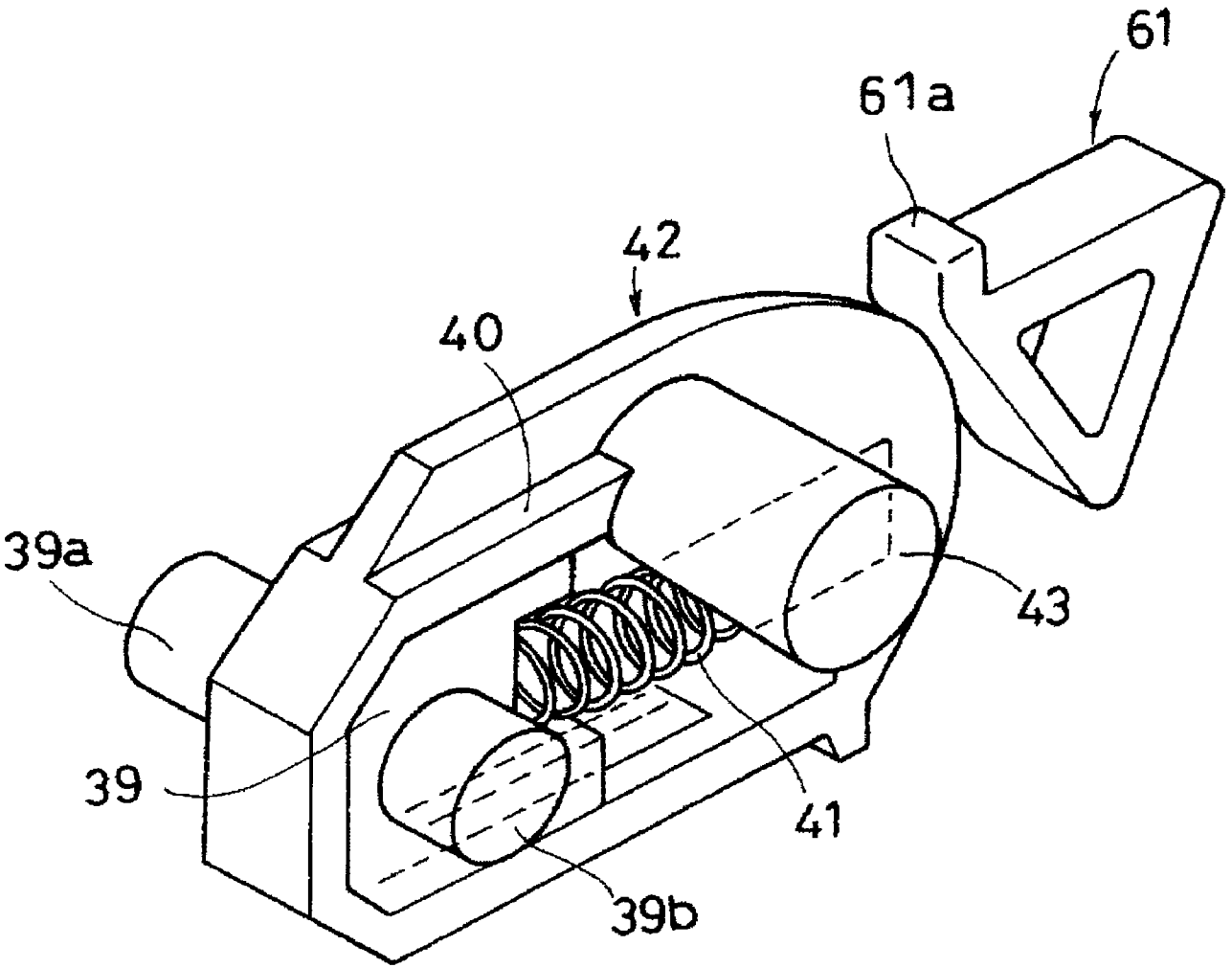
FIG. 10 is a perspective view of an urging device and an action-receiving portion according to at least one aspect of the invention.

An urging device 42 that presses the developing roller 22 against the photosensitive drum 13 via the developer cartridge 4 is pivotably and expandably mounted to an inner surface of each of the right and left sidewalls 30*c*, 30*e*. As shown in FIGS. 4 and 10, each urging device 42 has a pivot fulcrum member 39 provided with pivots 39*a*, 39*b* protruding integrally from the right and left sides thereof, a frame-like slide support member 40 that connects with and supports the pivot fulcrum member 39 that facilitates sliding movements therein, and an urging spring device 41, such as a coil spring or the like, that is disposed in the frame of the slide support member 40 so as to urge the pivot fulcrum member 39 in one direction. The slide support member 40 has a cylindrical motion acting portion 43 extending laterally. The motion acting portion 43 of each urging device 42 is disposed so as to protrude outward from a guide hole 44 formed in the corresponding one of the right and left sidewalls 30*c*, 30*e*.

A lock device 46 is disposed at an inner side of the sidewalls 30*e* (the right sidewall as shown) of the photosensitive member cartridge 3. The lock device 46 prevents the developer cartridge 4, which is fitted into the accommodating portion 32, from moving upward out of the accommodating portion 32. As shown in FIGS. 4, 5, 11A and 11B, the lock device 46 is designed so that a rotating shaft 48 extending through the sidewall 30*e* axially supports a lock lever 47 in such a manner that the lock lever 47 is pivotable relative to a side surface of the lock lever 47. A resin-made spring 49 extending downward from a lower end of the lock lever 47 is disposed so that a lower portion of the resin-made spring 49 contacts a restriction piece 30*d* protruding upward from the bottom wall 30*a* of the case 30. A lower surface of the lock lever 47 has an arched contact portion 47*a* that restricts upward motion of one of action-receiving portions 61 (right-side one) protruding outward from the right and left side surfaces of the case 21 of the developer cartridge 4, by contacting an upper surface of the action-receiving portion 61. The action-receiving portions 61 have a generally inverted triangular shape in side view.

The action-receiving portions 61 are disposed so that they communicate with the lock device 46 and urging devices 42 that press the developing roller 22 against the photosensitive drum 13.

Figure 5:
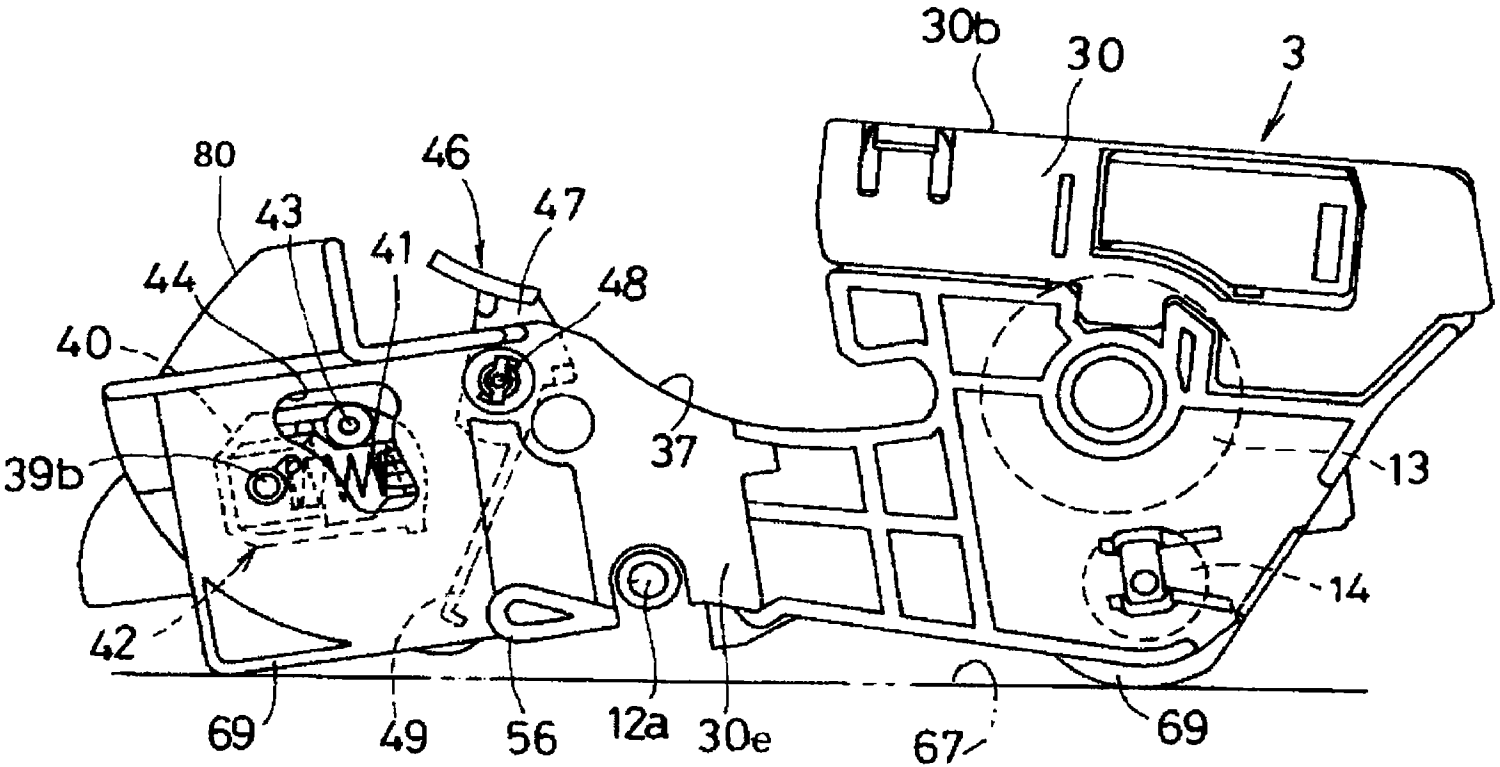
FIG. 5 is a right side view of the photosensitive member cartridge of FIG. 3.
Figure 21B:
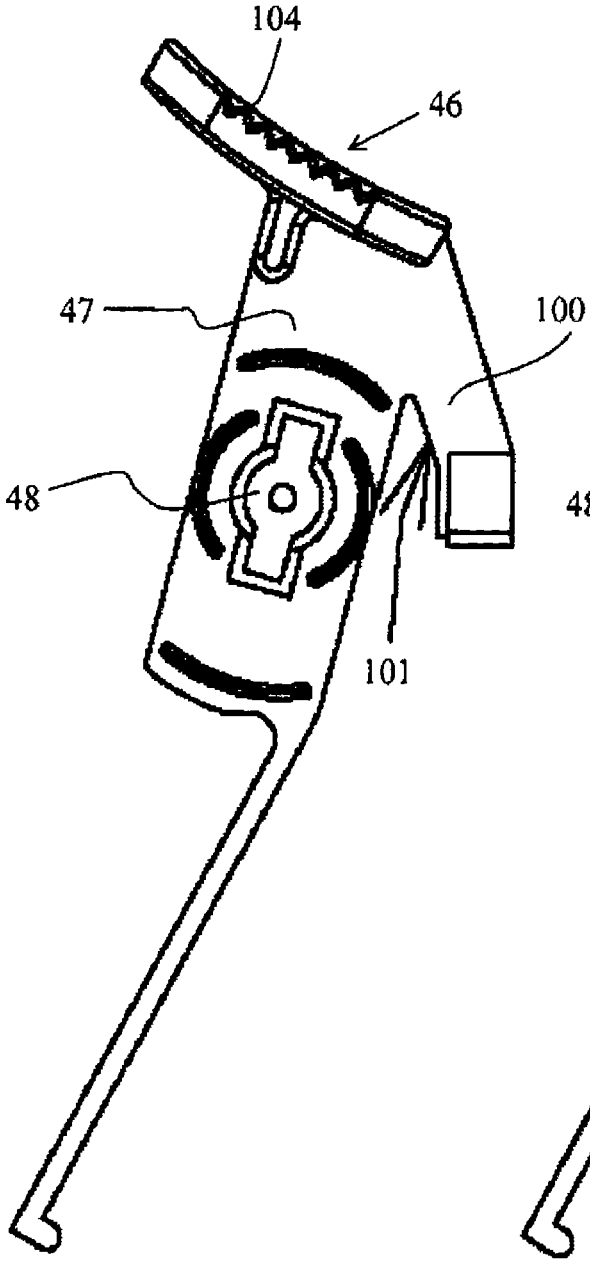
FIG. 21B is side view of a lock lever according to another aspect of the invention.
Figure 21A:
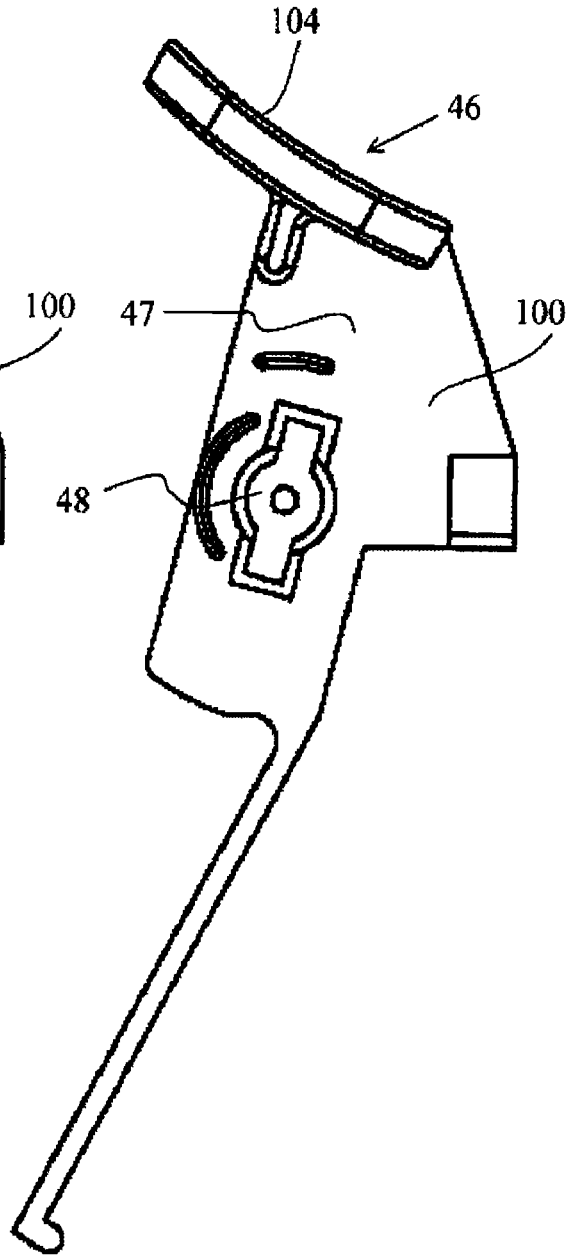
FIG. 21A is a side view of a lock lever according to at least one aspect of the invention.

The lock lever 47 of the lock device 46 may have a shape as shown in FIG. 21B as well as the shape as shown in FIGS. 4, 5, and 21A. Namely, in the shape shown in FIG. 21B, a protruding portion 100 of the lock lever 47 has a notch 101. The lock device 46 is attached to the sidewall 30*e* by inserting and rotating the rotating shaft 48, which is located in a substantially central portion of the lock lever 47, into a hole in the sidewall 30*e* of the case 30 of the photosensitive member cartridge 3. Due to the notch 101, a worker can attach the lock device to the sidewall 30*e* without excessive force, thereby improving assembly.

Figure 11A:
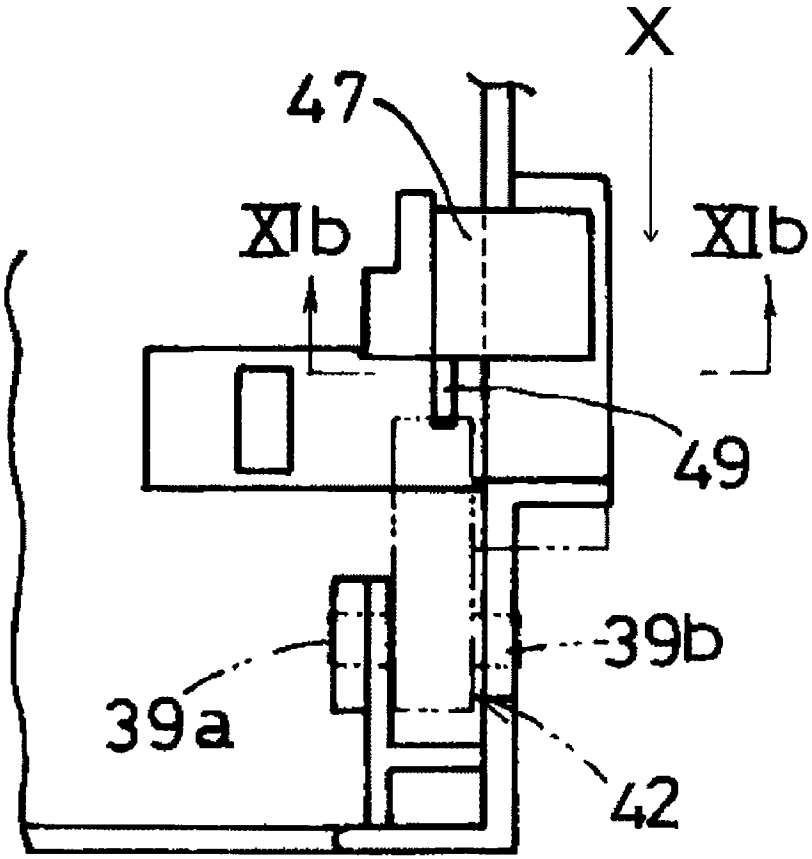
FIG. 11A is a plan view of a lock device according to at least one aspect of the invention.
Figure 11B:
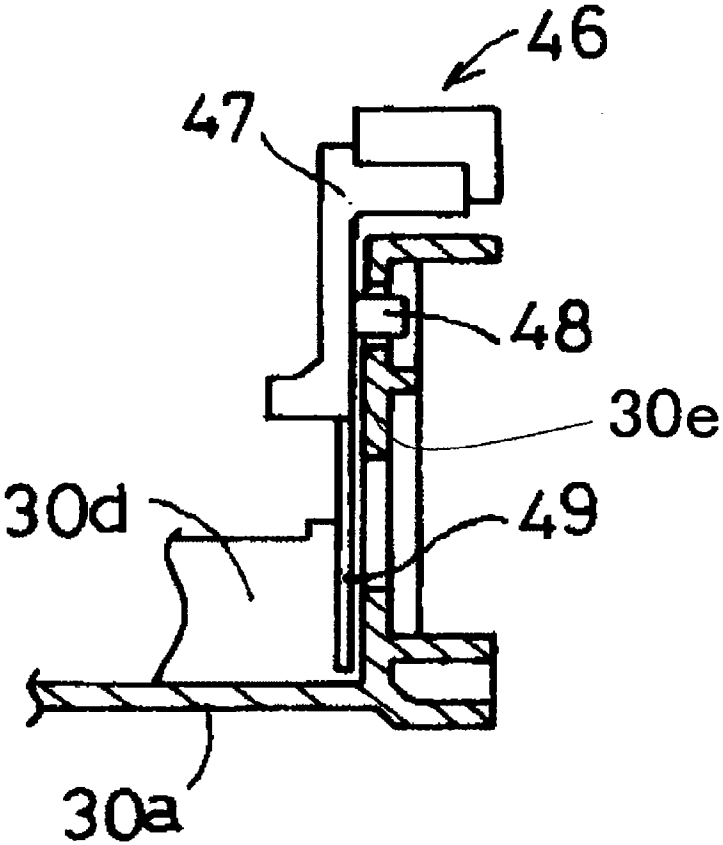
FIG. 11B is a sectional view taken along the line XIb-XIb in FIG. 11A.
Figure 22:
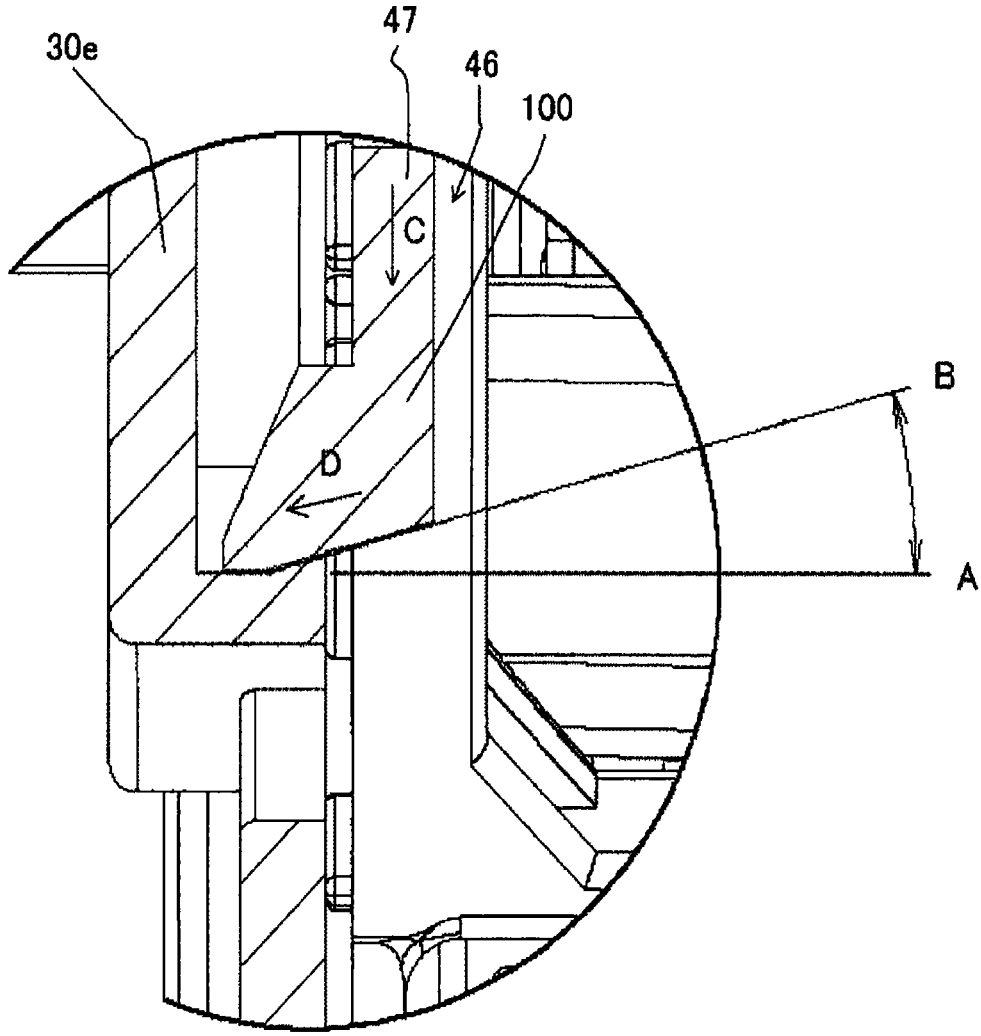
FIG. 22 is a partial enlarged view of the lock device, looking in direction X of FIG. 11A.

FIG. 22 is a partial enlarged view of the lock device 46, which is attached to the sidewall 30*e* of the photosensitive member cartridge 3, looking in a direction X of FIG. 11A (looking from the photosensitive member drum 13). This view shows the shape of the protruding portion 100 of the lock lever 47 in detail. As shown in FIG. 22, the protruding portion 100 of the lock lever 47 is formed along line B, which is slanted at a specified angle with respect to line A, which is parallel with the shaft of the photosensitive member drum 13. Thus, if a great force is applied to the protruding portion 100 in direction C, it is exerted so that the protruding portion 100 moves in direction D. The rotating shaft 48 of the lock lever 47 can be prevented from coming off the hole, so that the lock device 46 can be prevented from slipping off from the sidewall 30*e* of the photosensitive member drum 3.

Figure 23A:
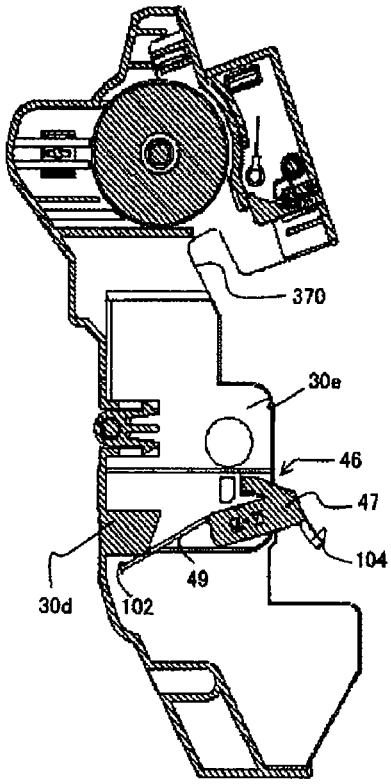
FIGS. 23A, 23B and 23C are side views of a sidewall of a photosensitive member cartridge, looking from inside according to aspects of the invention.
Figure 23B:
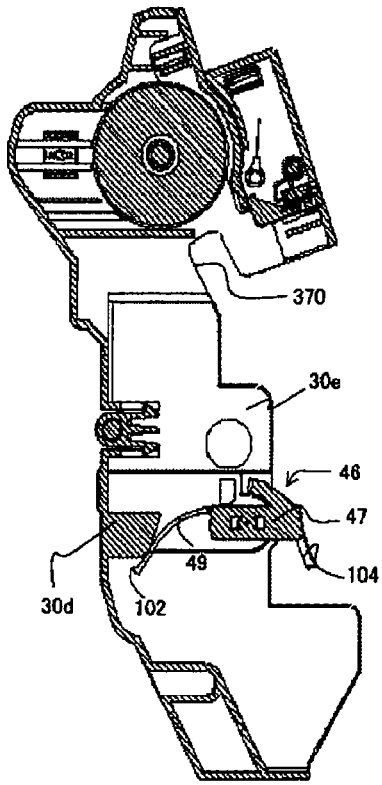
Figure 23C:
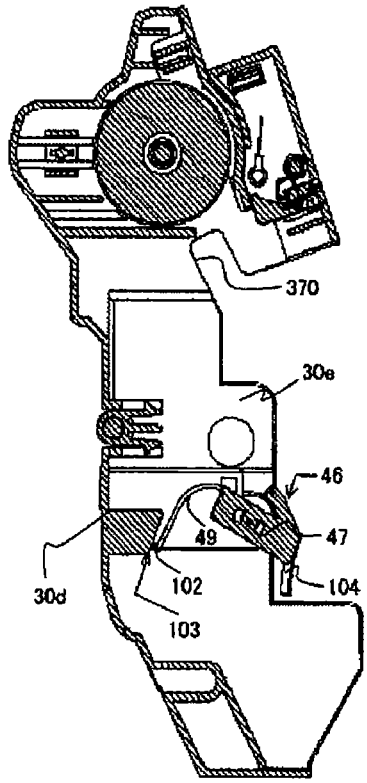

The resin-made spring 49 of the lock device 46 and the restriction piece 30*d* may be brought in contact with each other as shown in FIGS. 23A, 23B, and 23C. FIGS. 23A, 23B, and 23C are side sectional views of the sidewall 30*e* of the photosensitive member cartridge 3, looking from inside, and the developer cartridge 4 is omitted for the sake of convenience. FIGS. 23A, 23B, and 23C show how the lock device 46 undergoes displacement during the transition from a state where the developer cartridge 4 is locked in the photosensitive member cartridge 3 by the lock device 46 (see FIG. 23A) to a state where the lock between the developer cartridge 4 and the photosensitive member cartridge 3 is released (see FIG. 23C).

As described above, the resin-made spring 49 extending downward from a lower end of the lock lever 47 is disposed so that a lower portion of the resin-made spring 49 contacts a restriction piece 30*d* protruding upward from the bottom wall 30*a* of the case 30. The lock device 46 is configured so that a lock is released when the user depresses a pressing portion 104 of the lock lever 47. As the pressing portion 104 is depressed from the locked state of FIG. 23A as shown in FIG. 23B, the resin-made spring 49 is flexed elastically. As the pressing portion 104 is further depressed, an end portion 102 of the resin-made spring 49 climbs over a corner portion 103 of the restriction piece 30*d* as shown in FIG. 23C. At this time, a sense of click is transmitted to the user via the pressing portion 104. Thus, a moment when the lock is released is tactually transmitted to the user, so that the developer cartridge 4 can be removed from the photosensitive member cartridge 3 after the lock is completely released, and convenience of operation can be improved.

Figure 3:
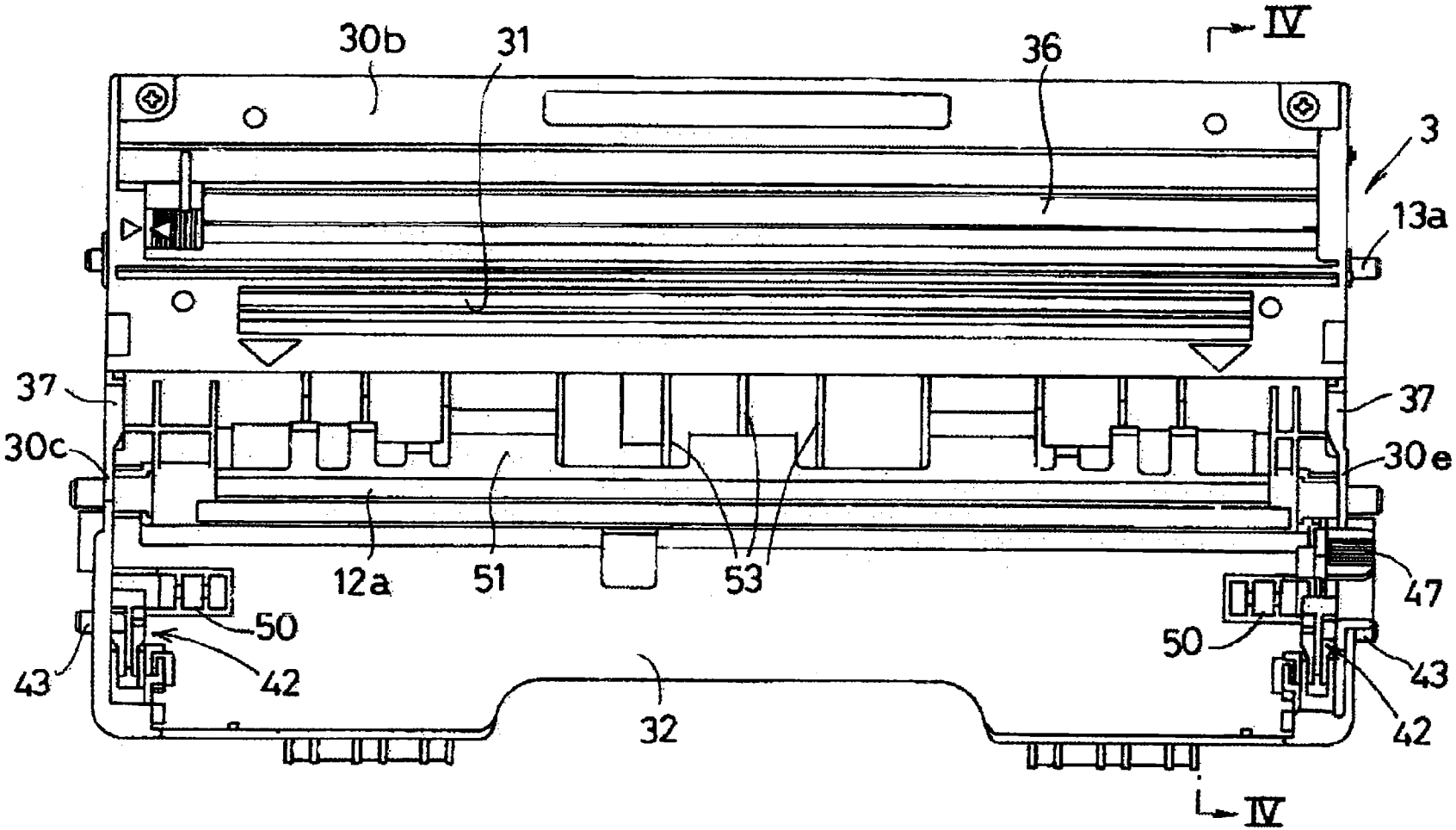
FIG. 3 is a plan view of a photosensitive member cartridge according to at least one aspect of the invention.
Figure 12A:
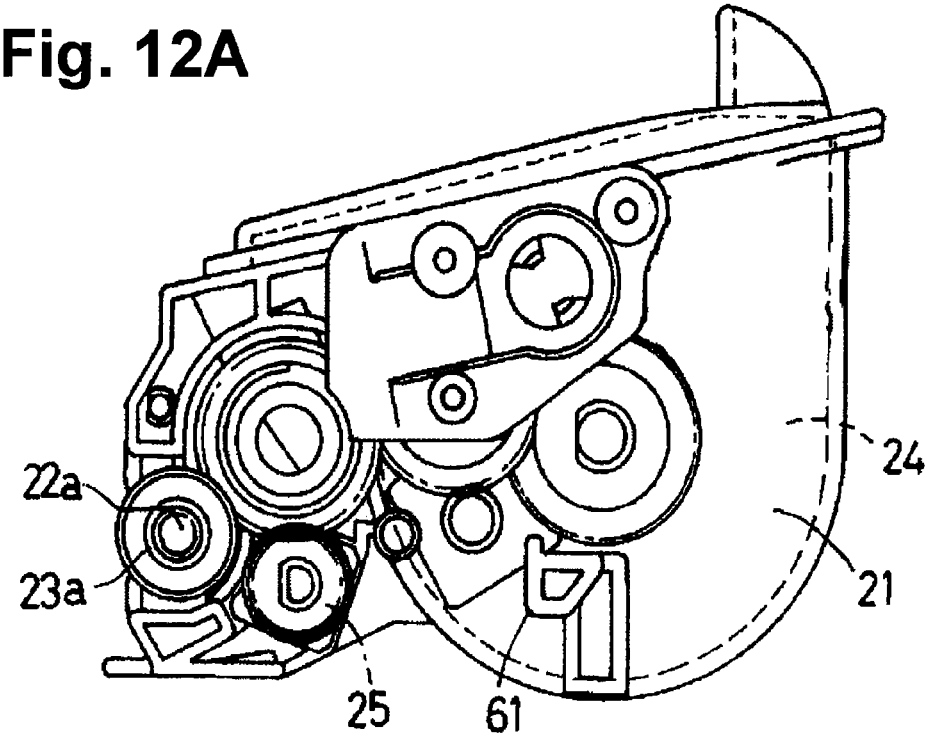
FIG. 12A is a left side view of a developer cartridge according to at least one aspect of the invention.

In the accommodating portion 32 of the photosensitive member cartridge 3, rollers 50, as receiving members, are disposed at positions (two positions in this aspect, that is, at right and left end portions) in the bottom wall 30*a* of the case 30 (see FIGS. 3 and 4). The rollers 50 protrude from the inner surface of the bottom wall 30*a*. When the developer cartridge 4 is inserted down into the accommodating portion 32, the rollers 50 sustain part of the weight of the developer cartridge 4, at a side across the developing roller shaft 22*a* of the developing roller 22 from the photosensitive drum 13, that is, a side of the developing roller shaft 22*a* of the developing roller 22 opposite from the photosensitive drum 13. More specifically, the rollers 50 contact a lower surface of the toner containing chamber 24 (see FIGS. 1, 12A and 12B), which is formed in a downward-convex shape and provided in the case 21 of the developer cartridge 4, and the rollers 50 reduce the rattling of the case 21 during the setting or removing operation.

The upper roller 12*a* of the pair of register rollers is mounted to the bottom wall 30*a* of the case 30 of the photosensitive member cartridge 3 in such a manner to prevent detaching. The bottom wall 30*a* has a laterally elongated introduction hole 51 adjacent to the upper roller 12*a*, to introduce the sheet P from the pair of register rollers 12*a*, 12*b* into a transfer portion 52 between the photosensitive drum 13 and the transfer roller 14. The upper surface of a portion of the bottom wall 30*a* extending between the introduction hole 51 and the transfer portion 52 has many ribs 53 extending in a direction from the introduction hole 51 to the transfer portion 52. The ribs 53 are designed so that the sheet P can be smoothly conveyed with a reduced contact resistance on the lower surface of the sheet P.

The structure of the developer cartridge 4 will be described with reference to FIGS. 1, 12A, 12B and 13 through 15. After toner in the toner containing chamber 24 in the case 21 is stirred by a rotationally driven stirrer 27 and discharged therefrom, toner is carried onto the outer peripheral surface of the developing roller 22 via a supply roller 25. A blade 26 is provided for restricting the layer thickness of toner on the developing roller 22 (see FIG. 1). The generally inverted triangular-shaped action-receiving portions 61 protrude from the right and left side outer ends of the toner containing chamber 24 in the case 21 of the developer cartridge 4.

The developing roller 22 has a rubber roller supported on the developing roller shaft 22*a* made of a metal, such as a stainless steel or the like. The rubber roller is made of a base material, which is provided with electric conductivity by dispersing carbon black in a silicone rubber or a urethane rubber. The roller surface has a coating layer containing fluorine. The shaft bearings 23*a*, 23*b* rotatably fitted to the right and left end portions of the developing roller shaft 22*a* are formed from a material whose friction coefficient is small, such as a polyacetal resin or the like. Each of the bearings 23*a*, 23*b* has an engaging nail 62 that engages with an annular groove 63 to prevent detaching from the shaft end. Each of the shaft bearings 23*a*, 23*b* has, at its base end side, an umbrella-shaped (conical) shaft diameter adjusting portion 64 whose diameter gradually increases. At least one of the shaft bearings 23*a*, 23*b* (the right-side bearing 23*b* in this example) is slidingly urged laterally outward by a spring device 65 (see FIG. 15). Therefore, when the developer cartridge 4 is set in position in the photosensitive member cartridge 3, the developing roller shaft 22*a* of the developing roller 22 is supported, without rattling, with respect to the guide grooves 37 formed in the right and left sidewalls 30*c* of the photosensitive member cartridge 3. Since both end portions of the developing roller shaft 22*a* serve as protrusions on both side ends of the developer cartridge 4 that engage with the guide grooves 37, the positioning or assembling precision can be improved and the production cost can be reduced. Furthermore, since the developing roller shaft 22*a*, extending through the case 21 of the developer cartridge 4, is made of a metal, the strength increases, so that the developing roller shaft 22*a* is less prone to breakage.

Figure 16:
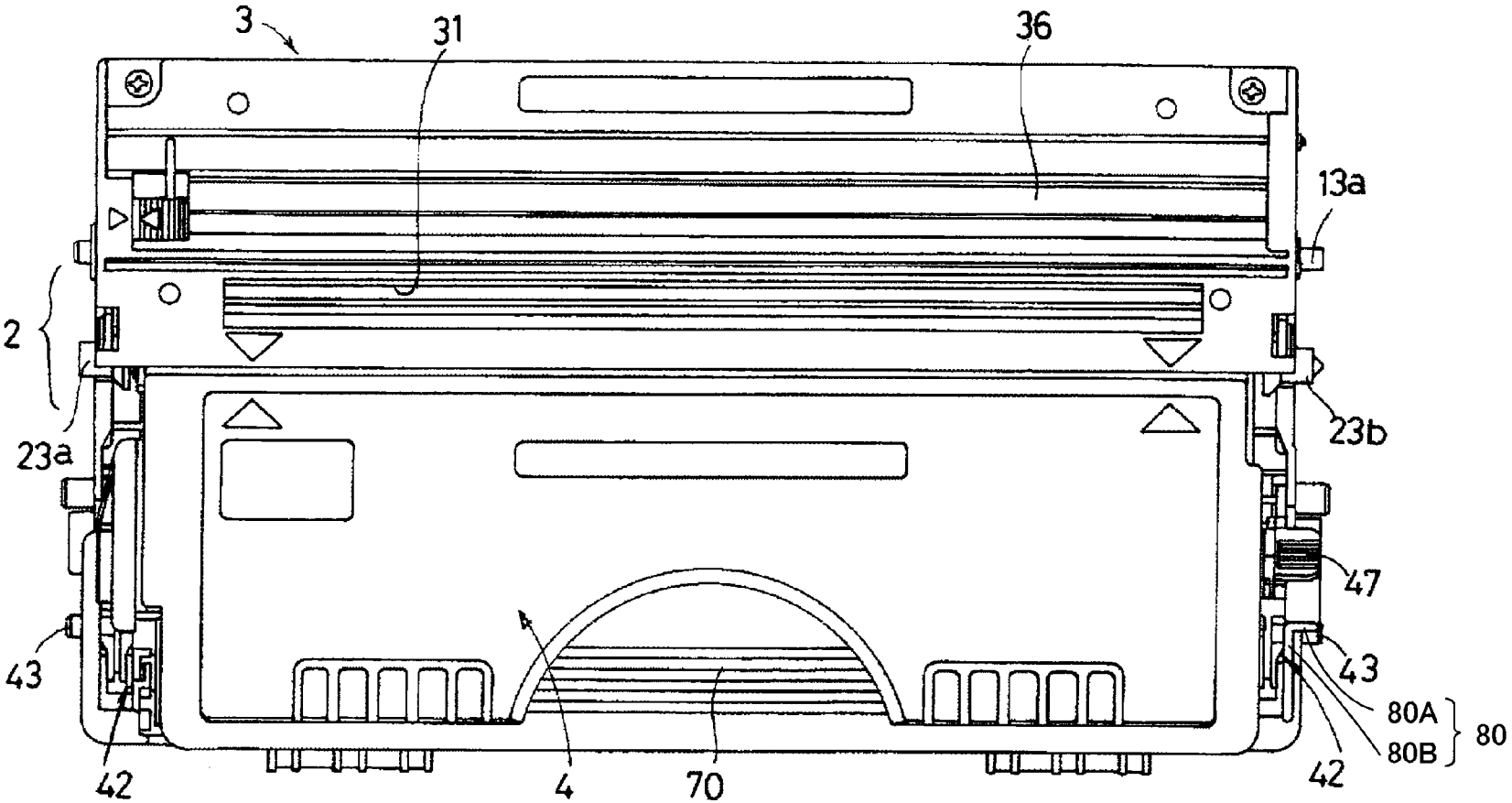
FIG. 16 is a plan view of a process cartridge according to at least one aspect of the invention.
Figure 19:
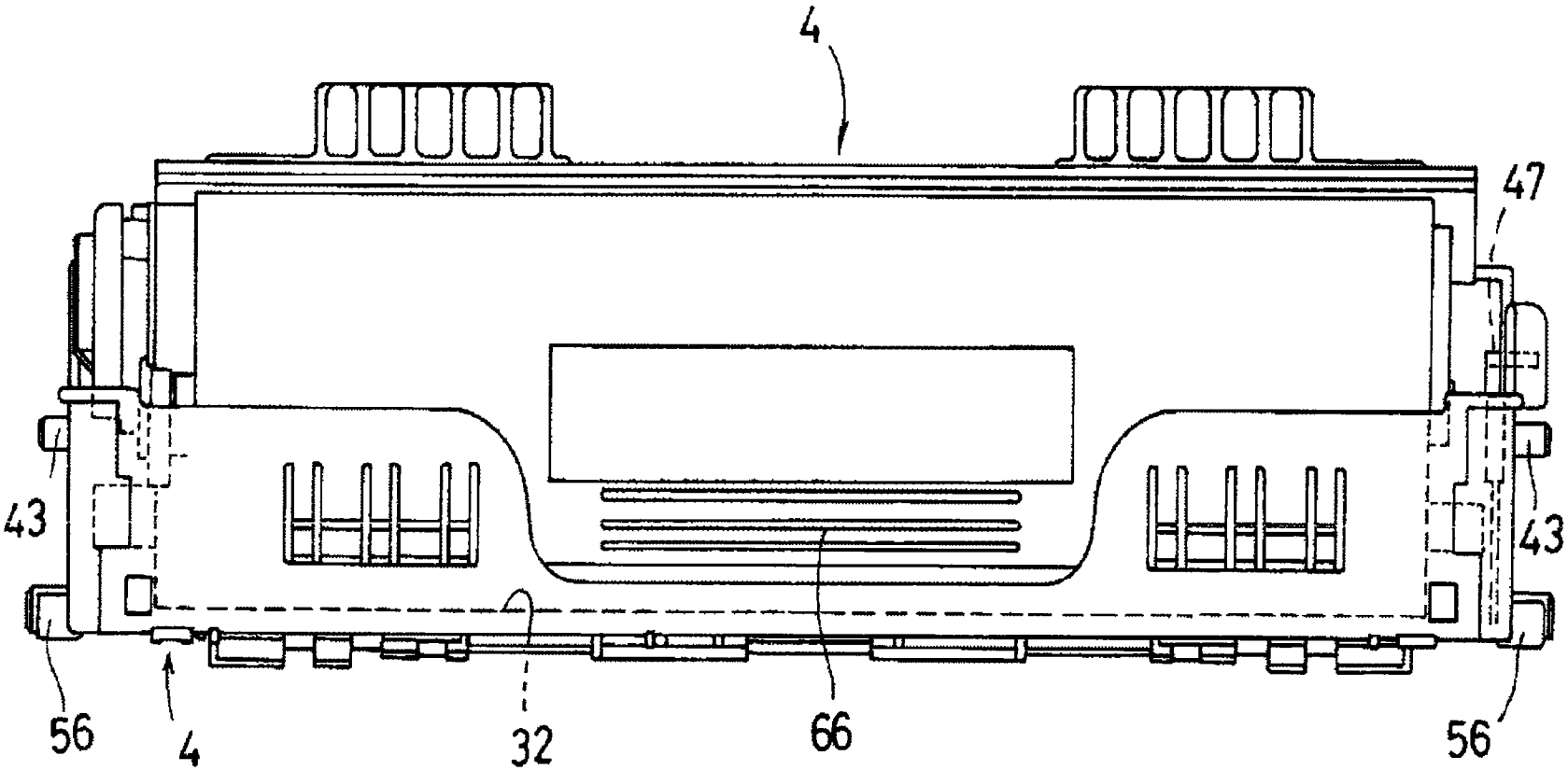
FIG. 19 is a view of the process cartridge taken along the line XIX-XIX in FIG. 17.

As shown in FIGS. 1, 16 and 19, the case 21 of the developer cartridge 4 has, in an upper surface portion and a lower surface portion thereof, grip portions 70, 66, respectively, that facilitate the handling of the developer cartridge 4, such as transportation thereof and the like. As shown in FIGS. 5 through 7, the case 30 of the photosensitive member cartridge 3 has foot portions 69 at positions (at least two positions and, preferably, four positions) that stabilize the photosensitive member cartridge 3 when it is placed on a table 67.

Figure 12B:
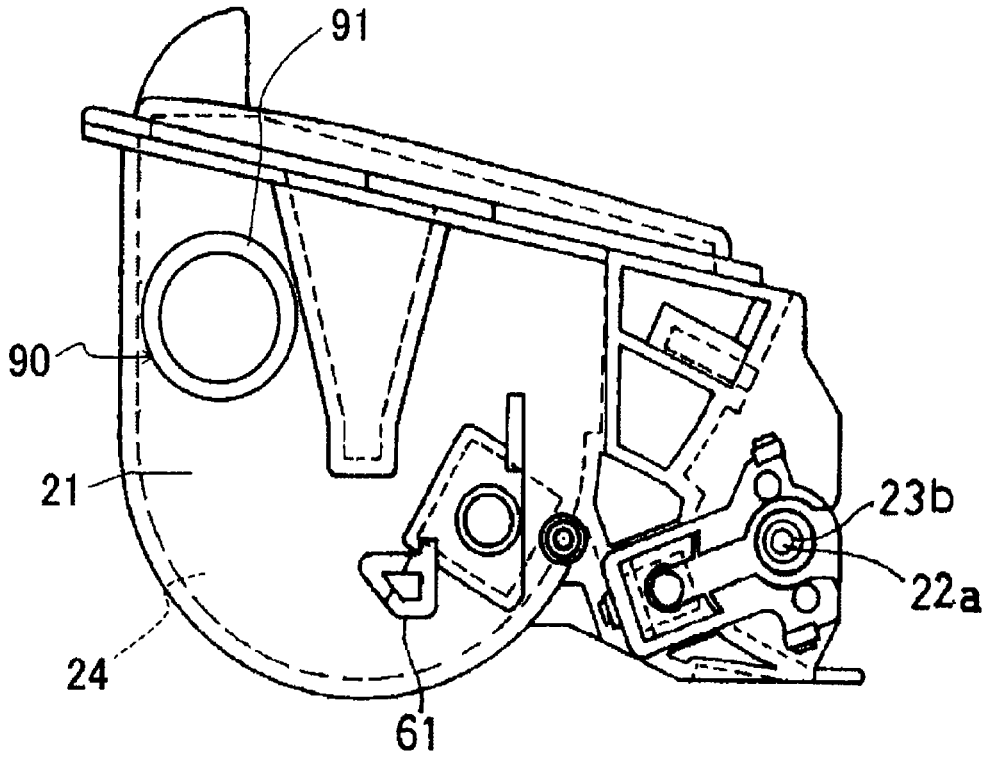
FIG. 12B is a right side view of the developer cartridge of FIG. 12A.

An inlet 90 through which toner is supplied to the toner containing chamber 24 is provided on a sidewall of the case 21 of the developer cartridge 4, as shown in FIG. 12B. As printing is continued in the image forming apparatus, toner is used up and then becomes empty, so that printing finally can no longer continue. The developer cartridge 4 whose toner has been used up is replaced with a developer cartridge filled with toner, thereby making printing possible again. The developer cartridge 4 whose toner has been used up is collected to be recycled by a manufacturer or recycling factory. In recycling, toner remaining in the toner containing chamber 24 is removed, the developer cartridge 4 is filled with new toner by supplying it from the inlet 90, and a cap 91 is fitted in the inlet 90 to seal it. Thus, the developer cartridge 4 is made usable again.

The operation of setting the developer cartridge 4 with respect to the photosensitive member cartridge 3 will be described.

When the developer cartridge 4 is inserted into the upwardly open accommodating portion 32 provided in a rearward portion of the case 30 of the photosensitive member cartridge 3, the action-receiving portions 61 formed on each side outside wall of the developer cartridge 4 contacts the corresponding lock lever 47, and turns the lock lever 47 to a position indicated by a double dashed chain line in FIG. 4, against the urging force of the resin-made spring 49. When the developer cartridge 4 is thus inserted, the action-receiving portion 61 is lowered and, therefore, the contact between the action-receiving portion 61 and the lock lever 47 is released. Therefore, the lock lever 47 is returned to the position indicated by a solid line in FIG. 4, by the urging force of the resin-made spring 49, so that the contact portion 47*a* of the lock lever 47 faces an upper surface of the action-receiving portion 61, thereby establishing a locked state.

During the insertion of the developing roller 22 into the accommodating portion 32, the shaft bearings 23*a*, 23*b* disposed at the right and left side ends of the developing roller 22 slide down along the guide grooves 37 formed along the upper edges of the right and left sidewalls 30*c* of the case 30, so as to approach the shaft 13*a* of the photosensitive drum 13. The case 21 of the developer cartridge 4 pivots about the bearings 23*a*, 23*b* of the developing roller shaft 22*a* of the developing roller 22. Therefore, when the bearings 23*a*, 23*b* come to positions on the guide grooves 37 close to the shaft 13*a* of the photosensitive drum 13 ("U"-shaped portions of the guide grooves 37), a toner containing chamber 24 side portion of the case 21 of the developer cartridge 4 comes into the accommodating portion 32 of the photosensitive member cartridge 3 by pivoting about the developing roller shaft 22*a* of the developing roller 22. Thus, the developer cartridge 4 is fittingly set in the accommodating portion 32.

In this state, the rollers 50 within the accommodating portion 32 slidingly contact a lower surface portion of the case 21 on the side of the toner containing chamber 24, and the bearings 23*a*, 23*b* move along the guide grooves 37 to such a position that the developing roller 22 is located substantially closest to the photosensitive drum 13. When the lock lever 47 pivots clockwise to return from the position indicated by the double dashed chain line to the position indicated by the solid line in FIG. 4, the contact portion 47*a* of the lock lever 47 faces the upper surface (protrusion 61*a*) of the action-receiving portion 61, so that the developer cartridge 4 is prevented from moving out of the photosensitive member cartridge 3.

At least one of the shaft bearings 23*a*, 23*b* on the developing roller shaft 22*a* is urged by the spring device 65 in a direction of the axis of the shaft such that the conical jaw portion of the bearing is pressed against an inner side edge portion of the guide groove 37. In this manner, the bearings 23*a*, 23*b* are slid along the guide grooves 37. Therefore, even if there is some dimensional error between the distance between the bearings 23*a*, 23*b* and the distance between the guide grooves 37, the developer cartridge 4 is prevented from shifting or oscillating laterally relative to the photosensitive member cartridge 3 (in the directions of the axis of the developing roller 22).

Furthermore, since the bearings 23*a*, 23*b* are pivotable relative to the guide grooves 37, the bearings 23*a*, 23*b* of the developer cartridge 4 can be smoothly moved along the guide grooves 37, without the danger of being stopped on the grooves 37, when the developer cartridge 4 is to be set with respect to the photosensitive member cartridge 3 or removed therefrom.

As described above, the sidewall 30*e* of the photosensitive member cartridge 3 is formed with the lock device 46 that prevents the developer cartridge 4 from moving upward. A protection wall 80 is formed so as to protrude upward in front of the lock device 46 with respect to a direction where the developer cartridge 4 is removed from or attached to the photosensitive member cartridge 3. The protection wall 80 protects the lock device 46. (See FIG. 5.) The protection wall 80 includes a protection wall 80A that faces the lock device 46 and a protection wall 80B that faces the toner cap 91. The protection walls 80A and 80B are connected in the shape of an L in a plan view, that is, the protection wall 80A perpendicularly intersects the protection wall 80B, as shown in FIG. 16. The protection wall 80A is substantially a trapezoid and includes an inclined side on a side away from the lock device 46 as shown in FIG. 17.

As the photosensitive member cartridge 3 and the developer cartridge are individually replaceable according to their life cycles, it is possible to obtain only the photosensitive member cartridge 3. During a period of time from when the photosensitive member cartridge 3 is factory-shipped to when it is delivered to a user and actually installed in the apparatus body, if a force is continuously applied to the lock device 46 from above, the resin-made spring 49, which extends downward from the lower bottom of the lock lever 47, may be continuously warped and permanently deformed, resulting in improper operation. The protection wall 80 is designed to protect the lock device 46 from such a force. The protection wall 80 is formed so that it is higher than the lock lever 47 in a vertical direction when the photosensitive member cartridge 3 is placed on the table 67. Thus, the protection wall 80 can protect the lock device 46 from excessive external force.

FIGS. 16 through 19 are a plan view, a right side view, a left side view, and a rear view (a view of the side of the sheet discharge opening) of the process cartridge 2 with the developer cartridge 4 set with respect to the photosensitive member cartridge 3.

Figure 17:
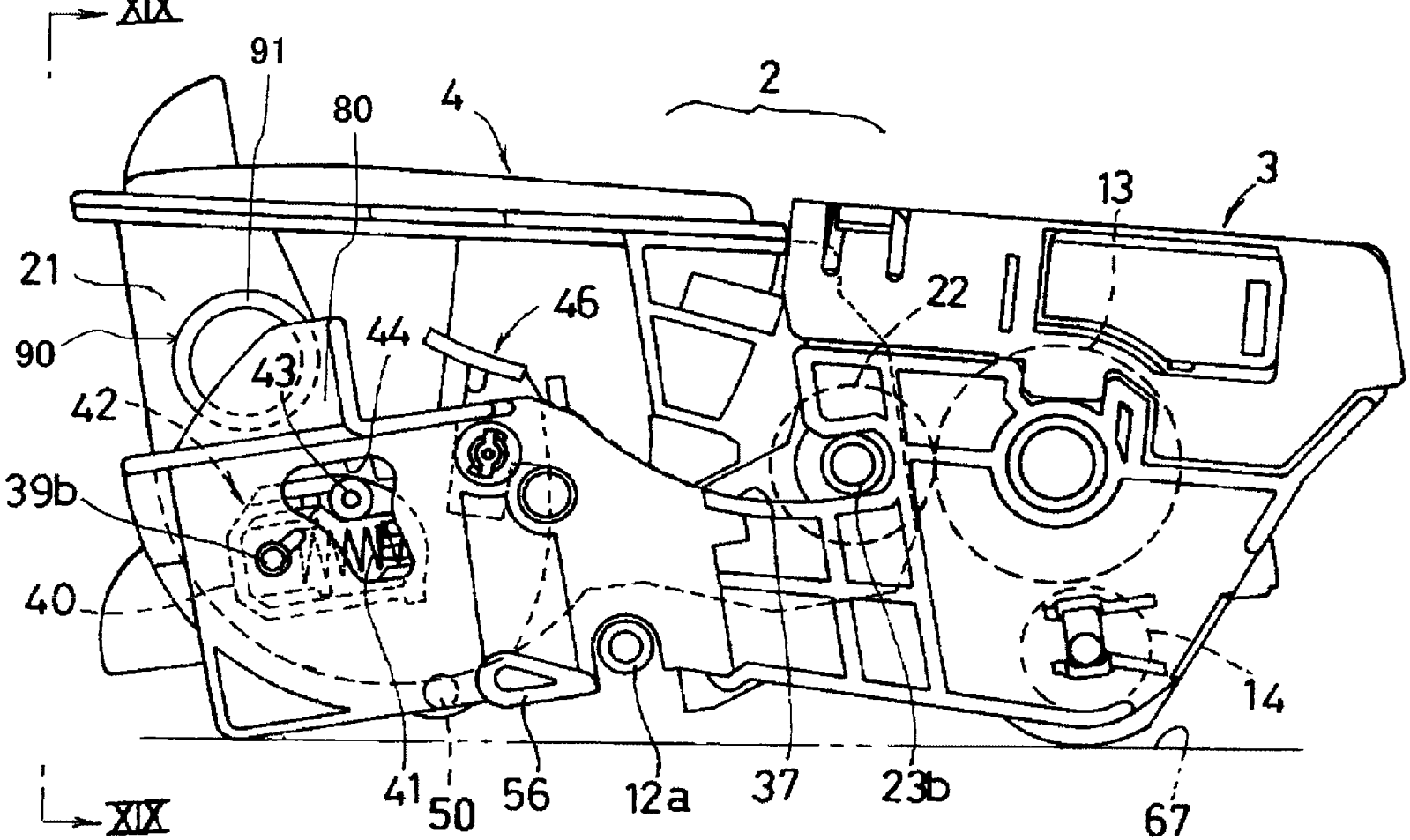
FIG. 17 is a right side view of the process cartridge of FIG. 16.
Figure 18:
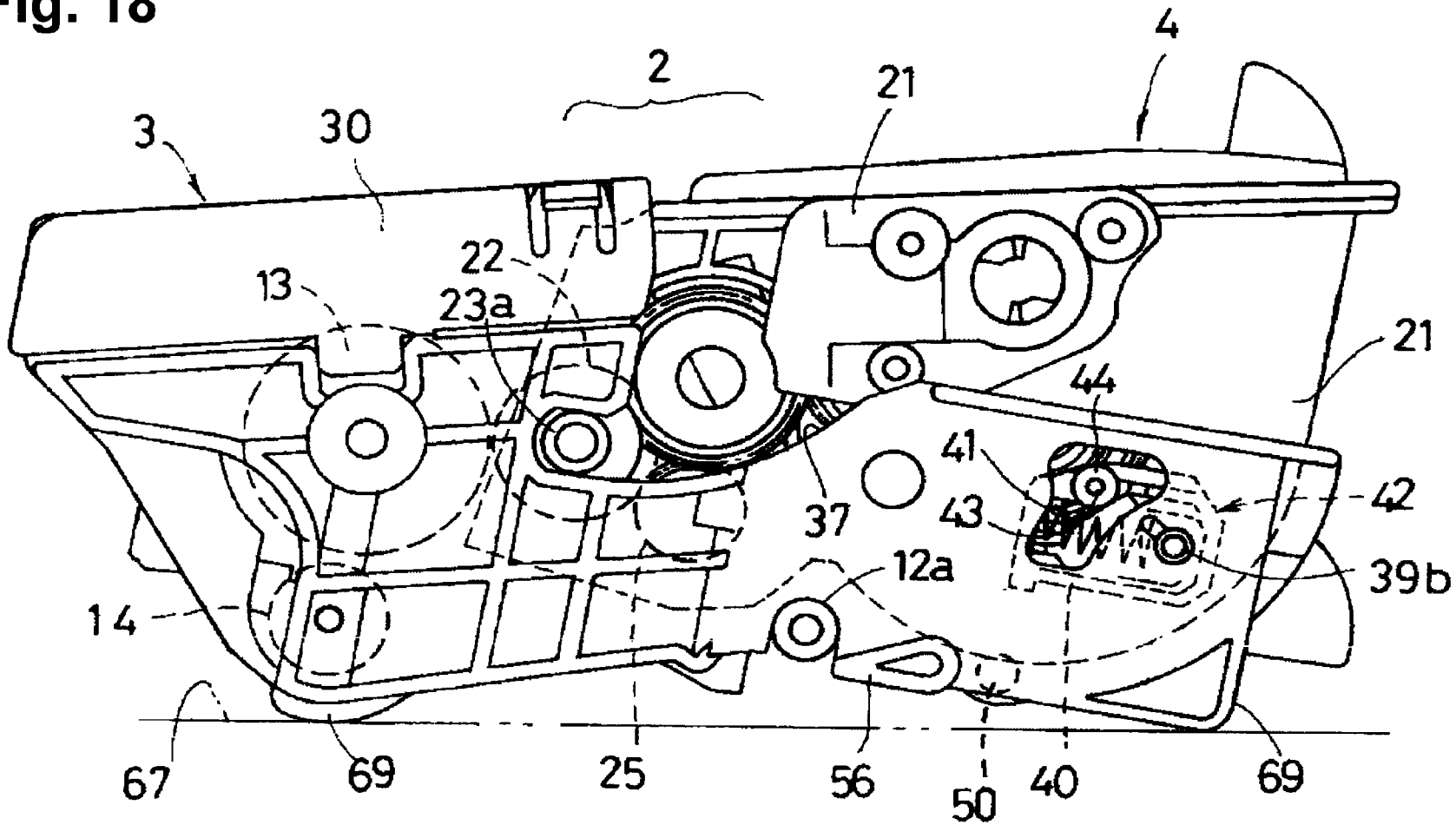
FIG. 18 is a left side view of the process cartridge of FIG. 16.

The inlet 90 formed in the developer cartridge 4 is disposed so that the protection wall at least partially overlaps the inlet 90 when the developer cartridge 3 is received in the photosensitive member cartridge 3 (see FIG. 17). Thus, in the process until the process cartridge 2 is delivered to the user or when the user installs the process cartridge 2 into the body housing 1, even if a strong force is applied to a toner cap 91 that seals the inlet 90 from outside, the protection wall 80 prevents the toner cap 91 from getting damaged or coming off. Thus, the protection wall 80 can prevent toner from leaking from the inlet 90 and the toner cap 91 from getting damaged or coming off. In addition, the protection wall can keep the inside of the apparatus from getting soiled because there is little likelihood that toner leaked inside the body housing 1 is dispersed.

The attaching of the process cartridge 2 to the body housing 1 will be described.

FIG. 2 is a partially cutaway side view illustrating a state where the process cartridge 2 is being inserted into the body housing 1. The process cartridge 2 is designed to be set into and removed from the body housing 1 when a lid 1*b* provided in the right-side end in FIG. 1 (a front face) of the body housing 1 is downwardly turned to form a large opening (see FIG. 2).

Figure 20A:
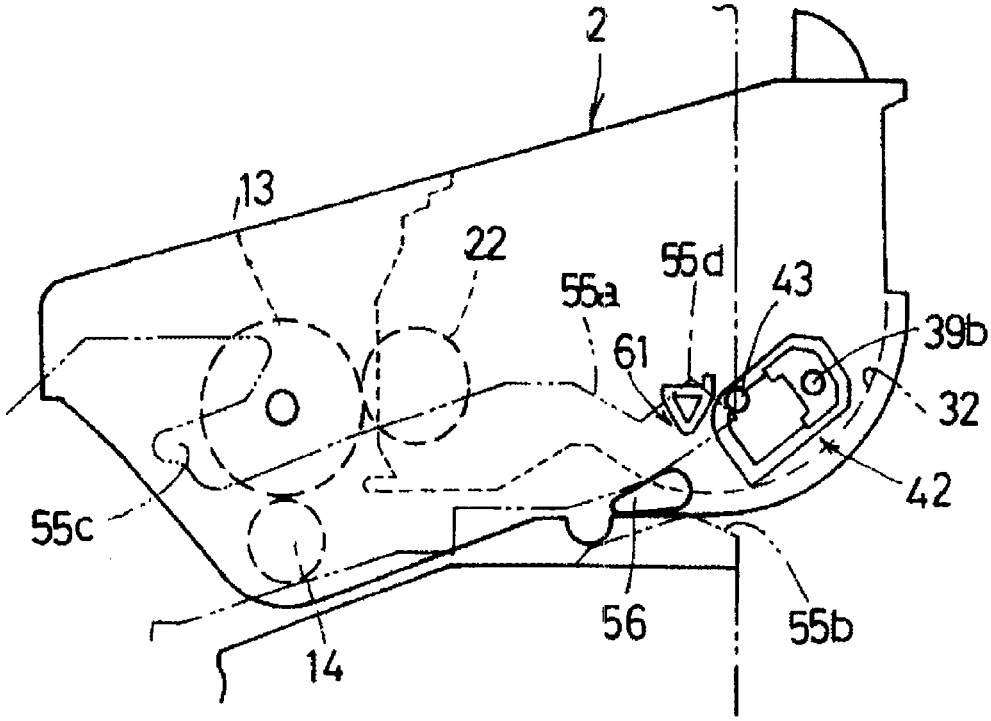
FIG. 20A illustrates the process cartridge of FIG. 16 being inserted into the body housing.
Figure 20B:
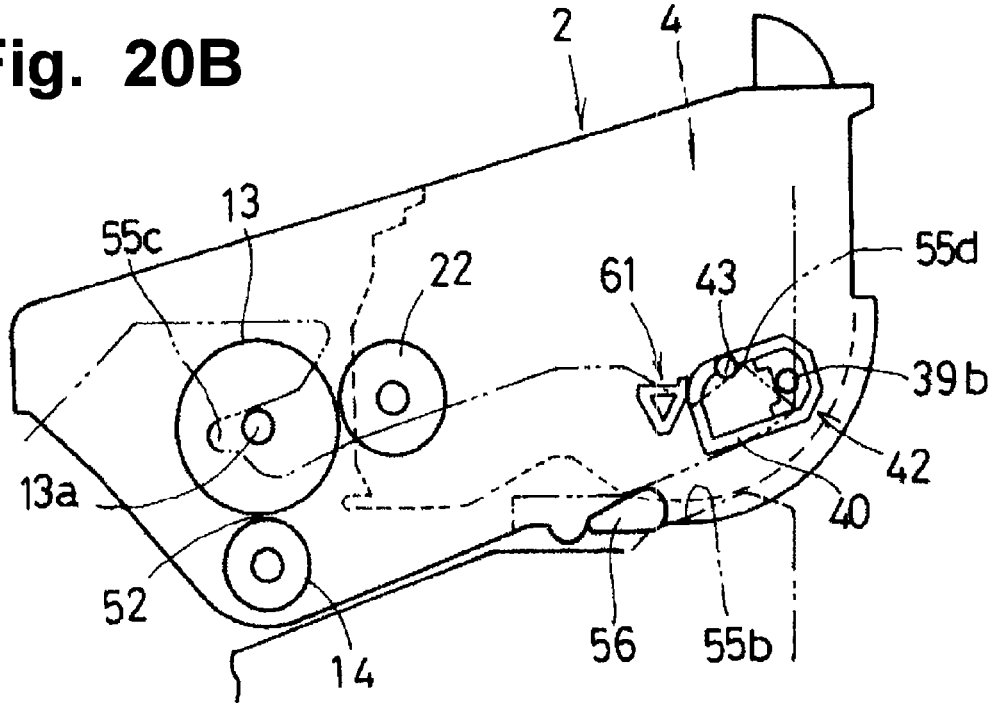
FIG. 20B illustrates the process cartridge of FIG. 16 being further inserted.

That is, as shown in FIGS. 2, 20A, and 20B, a pair of right and left guide devices 55, made of a resin or the like, can be fixed to the inner surfaces of the right and left side portions of the body housing 1 (in the drawings, only the right-side guide device 55 is shown). Each guide device 55 has a rising slope surface that is open upward and extends upwardly inward from the right-side end of the body housing 1, and an upper-side guide surface 55*a* extending downwardly inward from a summit 55*d* of the rising slope surface, and a lower-side guide surface 55*b* that is disposed below the upper-side guide surface 55*a* and that extends downwardly inward from the right-side end of the body housing 1, and ends at a position near the lower roller 12*b* of the pair of register rollers.

FIG. 2 indicates a position at which the insertion of the process cartridge 2 into the body housing 1 is started. The process cartridge 2 is inserted into the body housing 1 so that the shaft 13*a* of the photosensitive drum 13 approaches an upper inward end portion 55*c* of the upper-side guide surface 55*a*. Subsequently, as shown in FIG. 20A, the motion acting portion 43 of each urging device 42 contacts the rising slope surface of the upper-side guide surface 55*a*, and each of guiding members 56 protruding laterally from lower portions of the right and left sides of the process cartridge 2 (photosensitive member cartridge 3) fits into the lower-side guide surface 55*b* (only one of the guiding members 56 is shown in the drawings) so that the process cartridge 2 is prevented from moving upward relative to the body housing 1, and is allowed only to be moved further inward along the lower-side guide surface 55*b*.

In this state, as the process cartridge 2 is pushed inward, the motion acting portion 43 of each urging device 42 is raised by the corresponding upper-side guide surface 55*a* so that the slide support member 40 of each urging device 42 pivots upward about the pivot 39*a*, 39*b*. Therefore, the slide support member 40 of each urging device 42 restrains the corresponding one of the action-receiving portions 61 of the developer cartridge 4 in such a direction that a distal end portion of the slide support member 40 pushes the action-receiving portion 61. When the motion acting portion 43 of each urging device 42 comes to the summit 55*d* of the upper-side guide surface 55*a*, the slide support member 40 of each urging device 42 pivots to a most upward position. In this position, the slide support member 40 of each urging device 42 keeps the corresponding action-receiving portion 61 restrained at the distal end portion of the slide support member 40 (see FIG. 20B).

As the process cartridge 2 is pushed further inward, the shaft 13*a* of the photosensitive drum 13 is set to a predetermined position in the inward end portion 55*c* of each upper-side guide surface 55*a*. At this position, an operator releases the process cartridge 2 from the operator's hands, so that the developer cartridge 4 side portion of the process cartridge 2 is lowered and set by the weight of the process cartridge 2 into a state such that the upper register roller 12*a* disposed at a lower surface side of the case 30 of the photosensitive member cartridge 3 is placed on the lower register roller 12*b* disposed in the body housing 1, and is pressed by a spring 45, shown in FIG. 2 and, simultaneously, the guiding members 56 are supported at appropriate positions on the guide devices 55. In this state, the distal end of the slide support member 40 of each urging device 42 presses the corresponding action-receiving portion 61. Therefore, the developing roller 22 is pressed against the photosensitive drum 13 by the urging devices 42 and the action-receiving portions 61 via the developer cartridge 4.

The protection wall 80, which is configured to protect the lock device 46 formed on the sidewall 30*e* of the photosensitive member cartridge 3, is provided so as to at least partially overlap the inlet 90. When the process cartridge 2 is set in the body housing 1 by the above described method, there is little likelihood that the toner cap 91 is hit by a protruding member of the body housing 1. Thus, the toner cap 91 can be prevented from getting damaged or coming off. With this structure, the protection wall 80 can prevent toner from leaking from the inlet 90 and the toner cap 91 from getting damaged or coming off. In addition, the protection wall 80 can keep the inside of the apparatus from getting soiled because there is little likelihood that toner leaked inside the body housing 1 is dispersed. In addition, as the protection wall 80 protects both the lock device 46 and the inlet 90, a protection wall exclusively for protecting the inlet 90 need not be provided in the photosensitive member cartridge 3 and the developer cartridge 4.

It is to be understood that aspects of the invention are not restricted to the particular forms described above. Various modifications and alternations can be made thereto without departing from the scope of the invention.

What is claimed is:

1. A process cartridge comprising:

a photosensitive member cartridge including a first sidewall including a protection portion;

a second sidewall;

a photosensitive member disposed between the first sidewall and the second sidewall; and a lock device disposed on the first sidewall and configured to be moved between an unlocked position and a locked position;

a developer cartridge configured to be received in and removed from the photosensitive member cartridge, the developer cartridge including a developing roller configured to face the photosensitive member when the developer cartridge is received in the photosensitive member cartridge;

an inlet;

a covering element configured to seal the inlet; and a developer containing chamber configured to contain developer, the developing containing chamber communicating with the inlet, wherein the protection portion at least partially overlaps the covering element, viewed in a direction in which the photosensitive member extends, when the developer cartridge is received in the photosensitive member cartridge.

2. The process cartridge according to claim 1, further comprising an engaging member configured to be engaged with the lock device when the developer cartridge is received in the photosensitive member cartridge.

3. The process cartridge according to claim 1, wherein the lock device and the protection portion project vertically from the first sidewall in the same direction, and the protection portion projects from the first sidewall higher than the lock device.

4. The process cartridge according to claim 1, wherein the protection portion comprises a first surface and a second surface which perpendicularly intersects the first surface, the first surface partially overlapping the covering element.

5. The process cartridge according to claim 4, wherein the first surface of the protection portion faces the inlet.

6. The process cartridge according to claim 4, wherein the second surface of the protection portion faces the lock device.

7. The process cartridge according to claim 5, wherein the first surface of the protection portion is a trapezoid.

8. The process cartridge according to claim 7, wherein the first surface of the protection portion includes an inclined side on a side away from the lock device.

9. The process cartridge according to claim 1, wherein the developer cartridge includes a first chamber accommodating the developing roller and a second chamber containing developer, the first chamber and the second chamber communicating with each other.

10. The process cartridge according to claim 1, wherein the inlet has a shape devoid of a corner portion.

11. The process cartridge according to claim 1, wherein the inlet has a circular shape, the covering element has a circular shape, and the covering element fits in the inlet along an internal diameter of the inlet.

12. The process cartridge according to claim 11, wherein the covering element is a cap.

13. A photosensitive member cartridge configured to receive a developer cartridge, the developer cartridge including a developing roller; an engaging member, an inlet, a covering element configured to seal the inlet; and a developer containing chamber configured to contain developer and communicating with the inlet, the photosensitive member cartridge comprising:

a first sidewall including a protection portion;

a second side wall;

a photosensitive member disposed between the first sidewall and the second sidewall, the photosensitive member configured to face the developing roller when the photosensitive member cartridge receives the developer cartridge; and a lock device disposed on the first sidewall and configured to be moved between an unlocked position and a locked position and engaged with the engaging member when the photosensitive member cartridge receives the developer cartridge;

wherein the protection portion at least partially overlaps the covering element, viewed in a direction in which the photosensitive member extends, when the photosensitive member cartridge receives the developer cartridge.

14. A developer cartridge configured to be received in and removed from a photosensitive member cartridge, the photosensitive member cartridge including a first sidewall having a protection portion, a second sidewall, a photosensitive member disposed between the first sidewall and the second sidewall, a lock device disposed on the first sidewall and configured to be moved between an unlocked position and a locked position, the developer cartridge comprising:

a developing roller configured to face the photosensitive member when the developer cartridge is received in the photosensitive member cartridge;

an engaging member configured to be engaged with the lock device in the locked position when the developer cartridge is received in the photosensitive member cartridge;

an inlet;

a covering element configured to seal the inlet; and a developer containing chamber configured to contain developer, the developing containing chamber communicating with the inlet, wherein the protection portion at least partially overlaps the covering element, viewed in a direction in which the photosensitive member extends, when the developer cartridge is received in the photosensitive member cartridge.

15. An image forming apparatus comprising:

a housing; and a process cartridge including a photosensitive member cartridge including a first sidewall including a protection portion;

a second sidewall;

a photosensitive member disposed between the first sidewall and the second sidewall; and a lock device disposed on the first sidewall and configured to be moved between an unlocked position and a locked position; and a developer cartridge configured to be received in and removed from the photosensitive member cartridge, the developer cartridge including a developing roller configured to face the photosensitive member when the developer cartridge is received in the photosensitive member cartridge;

an engaging member configured to be engaged with the lock device;

an inlet;

a covering element configured to seal the inlet; and a developer containing chamber configured to contain developer, the developing containing chamber communicating with the inlet, wherein the developer cartridge and the photosensitive cartridge are received in and removed from the housing in a unified manner when the lock device engages with the engaging member, and the protection portion at least partially overlaps the covering element, viewed in a direction where the photosensitive member extends, when the developer cartridge is received in the photosensitive member cartridge.

* * * * *